United States Patent [19]

Hutchins et al.

[11] Patent Number: 4,488,355

[45] Date of Patent: Dec. 18, 1984

[54] METHODS OF AND APPARATUS FOR FORMING CONTACT ELEMENTS IN A CORD COUPLER HOUSING

[75] Inventors: Erle M. Hutchins, Bel Air; William M. Schoenemann, Jr., Baltimore, both of Md.

[73] Assignee: AT&T Technologies, Inc., New York, N.Y.

[21] Appl. No.: 393,991

[22] Filed: Jun. 30, 1982

[51] Int. Cl.[3] ..... H01R 43/04

[52] U.S. Cl. ..... 29/882; 29/876; 339/205

[58] Field of Search ..... 29/874, 749, 883, 882, 29/876, 564, 569.1, 564.2, 564.6; 339/205; 140/105, 71 R

[56] References Cited

U.S. PATENT DOCUMENTS

| | | | |
|---|---|---|---|
| 3,409,972 | 11/1968 | Cervenka et al. . | |
| 3,556,166 | 1/1971 | Whitney | 140/105 X |
| 3,562,903 | 2/1971 | Busler et al. . | |
| 3,947,958 | 4/1976 | Bowers . | |
| 4,082,409 | 4/1978 | Bailey et al. | 339/205 X |
| 4,148,539 | 4/1979 | Hardesty . | |
| 4,153,327 | 5/1979 | Johnson | 339/205 |
| 4,163,594 | 8/1979 | Aujla . | |
| 4,268,109 | 5/1981 | Hardesty . | |
| 4,292,736 | 10/1981 | Hughes et al. | 29/876 X |
| 4,296,550 | 10/1981 | Kobler | 29/876 X |
| 4,367,908 | 1/1983 | Johnson | 339/205 X |
| 4,379,609 | 4/1983 | Hardesty | 339/205 X |

OTHER PUBLICATIONS

West. Elect. Tech. Dig. No. 53, Jan. 1979, p. 21 Repair Tool for Modular Jacks by Reisinger et al.

*Primary Examiner*—Mark Rosenbaum
*Assistant Examiner*—Carl J. Arbes
*Attorney, Agent, or Firm*—Don P. Bush

[57] ABSTRACT

Methods and apparatus are provided for forming wire-like contact elements within a plastic housing (32) to form a coupler (35). Each of a plurality of leading end portions of wire supplies (61–61) is moved into a cavity at one end (38) of the plastic housing which is held in a nest (55), through one aligned passageway and into a cavity at the opposite end (37). The cavities are designed to receive modular plugs, the terminals of which are connected by the coupler. The leading end portions of the wires are formed into a retroflexed configuration (41) by tooling (57) which remains in the cavity at the opposite end (37) while the wire lengths in the housing are severed from their supplies adjacent to the cavity at the one end (38). Additional tooling (59) is moved to engage the newly formed trailing end portions of the wires and to bend them to have a retroflexed configuration (43) with free ends being disposed between partitions. The forming of the retroflexed ends is accomplished in a controlled manner so that following withdrawal of the tooling, the end portions move pivotally into predetermined configurations which are effective to engage the terminals of plugs which are inserted into the cavities.

25 Claims, 28 Drawing Figures

METHODS OF AND APPARATUS FOR FORMING CONTACT ELEMENTS IN A CORD COUPLER HOUSING

TECHNICAL FIELD

This invention relates to methods of and apparatus for forming contact elements in a housing to provide a cord coupler for telephone station apparatus. More particularly, it relates to methods of and apparatus for forming a plurality of resilient metallic wire-like contact elements within a cavity at each end of a unipartite plastic housing for establishing an electrical connection with a modular plug.

BACKGROUND OF THE INVENTION

A present arrangement in customer telephone station equipment includes a modular jack at a wall outlet and in a base of a telephone set. The telephone set is connected to the wall outlet through a line cord by inserting modular plugs at the ends of the line cord into the jacks. A customer may wish to place a telephone set at a particular location, but a wall outlet may not be near enough to permit connection with the initially provided line cord. Customers are able to relocate their telephone sets by using customized lengths of line cords joined together by couplers to extend from the sets to wall outlets.

While customer combinations of cords satisfies the desire for convenience and portability, it can lead to a problem. As is well known, most telephone cords are made by helically wrapping a plurality of tinsel ribbons about a center core and then insulating the ribbons. If the loop length from the wall outlet to the telephone and return is too lengthy, transmission characteristics will be affected because of excessive resistance. It has been recommended that the customer use cordage comprising stranded conductors, which has a lower resistance than tinsel conductor cordage, to extend the standard length line cord that is generally supplied with the telephone set.

The foregoing problem has been overcome by a cord of a system which includes a coupler having a disconnection encumberance. The coupler includes a unipartite housing which is made of a dielectric material. The housing has an externally communicating plug-receiving cavity at each end and a plurality of spaced passageways that extend from one end to the other. A contact element in the form of a wire having a linear portion is received in each passageway. Each end portion of each wire is formed into a retroflexed configuration. The externally communicating cavity at each end of the coupler is adapted to receive a modular plug having blade-like terminals which engage aligned ones of the retroflexed portions of the contact elements when the plug is inserted into one of the cavities. A modular plug at one end of a stranded conductor line cord of a desired length is inserted into a particular one of the coupler cavities. When a modular plug is inserted into that cavity, the modular plug, including a resilient locking tab, is disposed completely within the housing to preclude digital depression of the tab and withdrawal by a customer. This prevents inadvertent customer connection of excessive lengths of high resistance tinsel type cordage which could have adverse effects on the transmission characteristics of the customer loop.

If a wall outlet jack is positioned so that an existing line cord to a proposed telephone set location is of insufficient length, the telephone set is disconnected by removing the modular plug of the line cord from the wall jack. The disconnected plug of the line cord is inserted into the unused one of the two opposed cavities of the coupler at its so-called customer end. The uncoupled end of the stranded conductor line cord is inserted into the jack in the wall outlet. On the other hand, if the telephone set has been positioned at a location extremely remote from a wall outlet by the use of a tinsel line cord in combination with a stranded cord, it may be desired to move the set closer to the outlet. The stranded conductor line cord is easily disconnected by removing the uncoupled end of that line cord from the wall outlet and unplugging the end of the original line cord from the coupler jack and inserting it into the wall outlet.

Methods and apparatus are required for forming the contact elements within the one piece plastic housing. End portions of each contact element must be formed so that they are adapted to engage terminals of modular plugs which are inserted into the cavities at the ends of the coupler. Because it is expected that modular plugs will be moved into and out of the cavity at the customer end to permit telephone rearrangements, the end portions of the contact elements at the customer end must have a predetermined retroflexed configuration. This will ensure suitable contact with the terminals of a modular plug upon each insertion.

Another problem has arisen because of the relative sizes of the wires and of the passageways of the housing. It has been found that the passageways in the housing must be sized larger than the cross-section of the wire-like contact elements. Otherwise core pins which are used during the injection molding of the housing and which are moved into a mold from opposite ends are too flexible and are deflected out of alignment with each other during the molding. The oversizing of the passageways of the housing causes a problem when attempting to form the retroflexed end portions of the wires which are disposed in the one piece housing. Inasmuch as the cross-section of each wire is substantially smaller than the cross-section of each passageway, it will bow along its center portion when the end portions of the wires are being formed.

Seemingly, the prior art is devoid of methods and apparatus that meet these needs. What is needed are methods that are capable of implementation in a manual or automatic manner to load lengths of resilient metallic wires into a unipartite coupler housing and to form them into contact elements, the ends of which have a predetermined configuration.

SUMMARY OF THE INVENTION

The foregoing needs have been met by the methods and apparatus of this invention. The methods and apparatus are used to form a plurality of wire-like contact elements within a plastic housing with a center portion of each being disposed in a passageway which communicates with a plug-receiving cavity at one end of the housing and a plug-receiving cavity at the opposite end. Each of a plurality of lengths of resilient, metallic wire is preformed to have an offset portion along a center portion thereof. The offset portion of each length is spaced from an axis through its ends to cause the offset portion and portions adjacent to the center portion to engage opposite surfaces of a passageway in which it is to be disposed. Then, each of the lengths is moved into the housing to cause a first end portion to be disposed in the cavity at the one end of the housing and a second end portion in the cavity of the opposite end and to cause the offset center portion to be disposed in a passageway. The first and second end portions of the lengths of wire are caused to be formed into a retroflexed configuration by applying forces in a controlled manner to the lengths of wire between their center portions and their ends. The application of forces in a controlled manner is effective to allow the end portions of the resilient wires to move pivotally into predetermined positions when the application of forces is discontinued. The application of forces to the end portions of the wire lengths is discontinued and the end portions of each wire move to the predetermined positions.

In one embodiment, a housing is positioned in a nest and a cycle of operation is initiated. A wire guide is moved into the cavity at the one end of the housing such that guide channels are aligned with the passageways. A plurality of resilient metallic wires which are disposed in the channels have leading lengths thereof formed to include an offset after which the lengths of wires are moved along the channels to cause a leading end of each to be disposed in the cavity at the opposite end of the housing. The offset portions are disposed in the passageways with the trailing end portions connected to supplies. Tooling is caused to be operated to engage the leading ends of the wires and to bend them into a retroflexed configuration within the cavity at the opposite end of the housing. The bending is accomplished while each wire adjacent to its leading end portion and its offset is supported to control its deflection and to prevent inadvertent longitudinal movement. The tooling remains within the cavity at the opposite end of the housing and functions as an anvil while the wires within the housing are severed from their supplies. Other tooling is caused to be operated to engage the newly formed trailing ends of the wires and to form each of these end portions into a retroflexed configuration.

Afterwards, the tooling is withdrawn from each cavity whereupon the end portions of each length of resilient wire move relative to the offset into a predetermined retroflexed configuration. The predetermined retroflexed configuration is such that the wires are engaged by terminals of a modular plug which is inserted into each cavity.

A hand-operated tool may also be used to practice methods of this invention. In that use, a plurality of lengths of wire which have been preformed so each include an offset and a retroflexed configuration at one of its ends are loaded into the cavity at the one end of the housing. The housing is positioned to cause the retroflexed end portions to be engaged by an anvil to maintain them in position during the forming of the other ends of the wire lengths.

The hand tool includes a slotted end having an undercut groove across one face. An operator moves the tool at right angles to the housing to cause the slotted end to engage end portions of the lengths of wire which extend beyond the cavity at the opposite end of the housing. Then the operator causes a lip of the housing to be received in the undercut groove and rotates the tool to cause the end portions of the wires to be bent into a retroflexed configuration.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 1:
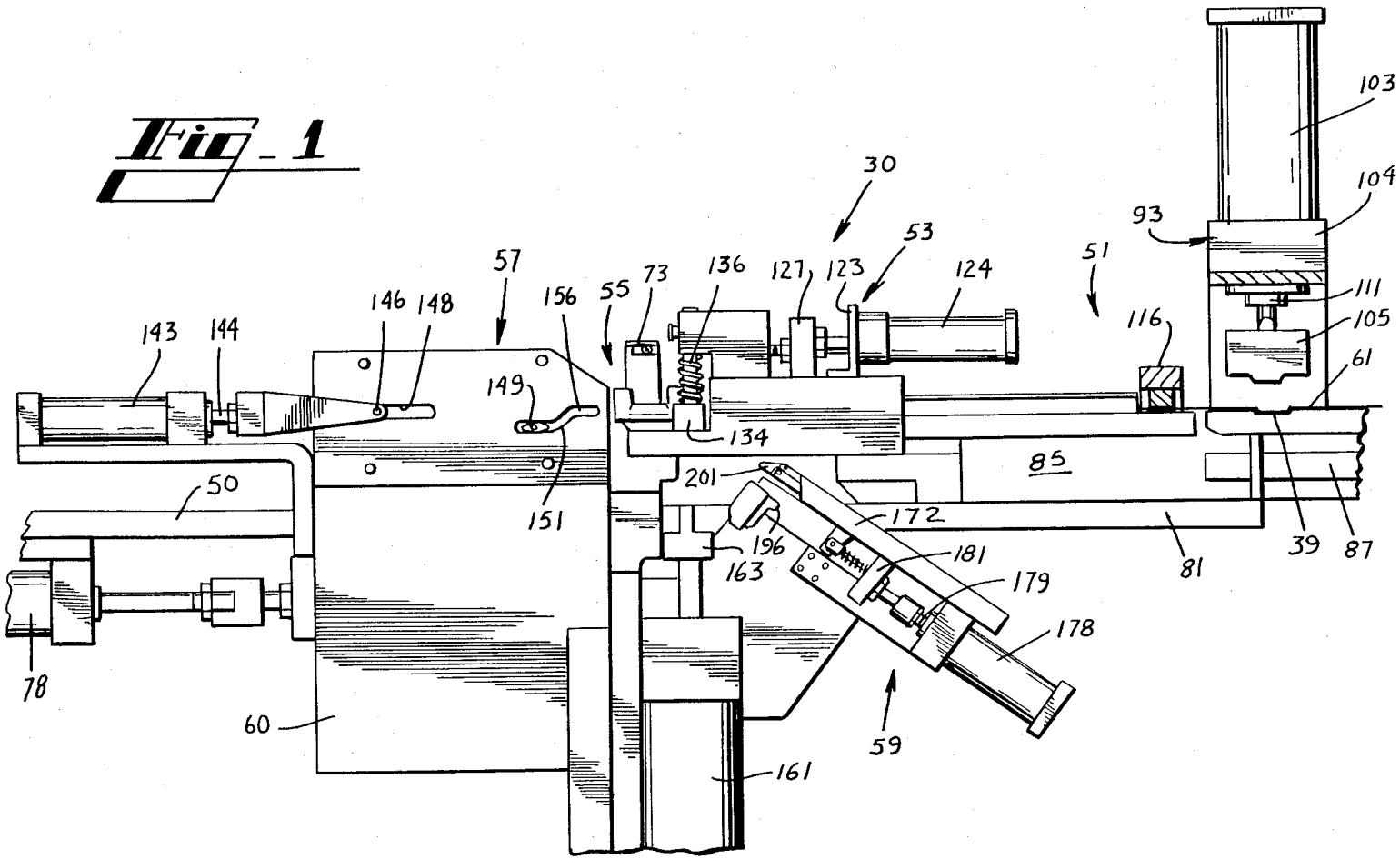
FIG. 1 an overall elevational view of an apparatus for forming contact elements within a plastic housing to provide a coupler.
Figure 2:
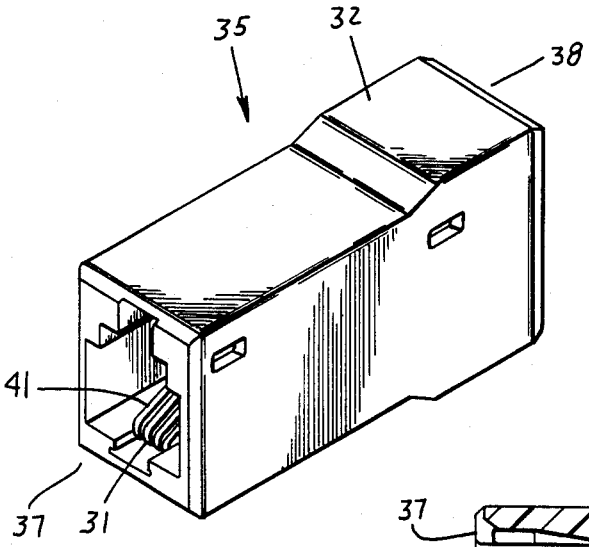
FIG. 2 is a perspective view of a coupler which is assembled by the methods and apparatus of this invention.

Referring now to FIG. 1, there is shown an apparatus which is designated, generally, by the numeral 30 for assembling a plurality of wire-like contact elements 31—31 (see FIG. 2) to a unipartite plastic housing 32 in order to form a coupler which is designated generally by the numeral 35. The contact elements 31—31 are made of a resilient metallic material such as Phosphor bronze, for example. The coupler 35 includes a customer end 37 and a locked plug end 38, and is disclosed and claimed in commonly assigned application Ser. No. 241,951 which was filed on Mar. 9, 1981 in the name of E. C. Hardesty. A jack cavity is formed in each of the ends 37 and 38, with each cavity adapted to receive a modular plug such as that shown in U.S. Pat. No. 4,148,539 which issued on Apr. 10, 1979, in the name of E. C. Hardesty. It should be observed that end 38 is enlarged over the customer end so that a plug may be wholly received in the cavity in that end to prevent its inadvertent removal. Accordingly, the end 38 is referred to as a cord end or a locked plug end.

Figure 3:
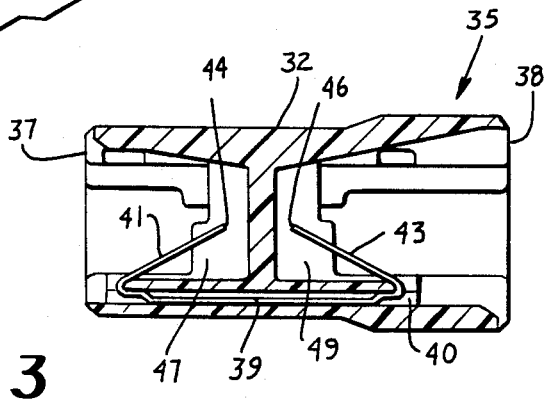
FIG. 3 is a front elevational view in section of the coupler of FIG. 2.

As will be observed from FIG. 3, the wire-like contact elements 31—31 are disposed in the plastic housing 32 to have offset portions 39—39 thereof disposed in passageways 40—40. Also, retroflexed end portions 41—41 are disposed in the customer end 37 and retroflexed end portions 43—43 in the end 38. As also will be seen by referring to FIG. 3, free ends 44 and 46 of the retroflexed end portions 41 and 43 are disposed between partitions 47—47 in the jack cavity in the end 37 and between partitions 49—49 in the cavity of the cord end 38. The separation of the free ends 44 and 46 by the partitions helps to prevent arcing between the ends when voltage surges occur. It is important that the retroflexed end portions be disposed in a predetermined position within the jack cavities in order to establish electrical contact with terminals of the modular plugs that are to be inserted in the jack cavities of the coupler 35.

Returning to FIG. 1, where there is shown an overall view of the apparatus 30, it should be observed that the apparatus includes a frame 50, a feeding portion which is designated generally by the numeral 51, guiding and cutting facilities for a plurality of wires, which is designated generally by the numeral 53, a nest, which is designated generally by the numeral 55, first forming tooling, which is designated generally by the numeral 57, and second forming tooling, which is designated generally by the numeral 59. The nest 55, the first forming tooling 57, and the second forming tool are mounted on a carriage 60.

A brief description of the sequence of operations is now given in order to better appreciate the detailed description of portions of the apparatus 30 and functions of each. Once an operator positions a coupler housing 32 in the nest 55 and depresses a pair of palm buttons (not shown), the operation of the apparatus 30 is entirely automatic. The carriage 60 is moved to the right as viewed in FIG. 1 to position the housing 32 adjacent to the guiding and cutting facilities 53 to allow the feeding portion 51 to feed a plurality of resilient, metallic wires 61—61 having offset portions 39—39 formed therealong. The wires are fed to position leading portions within the housing 32. Then the first tooling 57 bends each leading end portion into a retroflexed, generally U-shaped configuration while supporting the wires. The wires are severed adjacent to the locked plug end of the housing. Then the carriage 60 is moved to the left as viewed in FIG. 1 to space the coupler housing from the guiding facilities 53. The second tooling is operated to bend the trailing end portions of the wires into a generally U-shaped retroflexed configuration. Then the first and second tooling are withdrawn from the housing 32 and the coupler removed from the nest. The end portions of each resilient wire move pivotally and become angled to a center portion of the wire in a predetermined retroflexed configuration.

Figure 4:
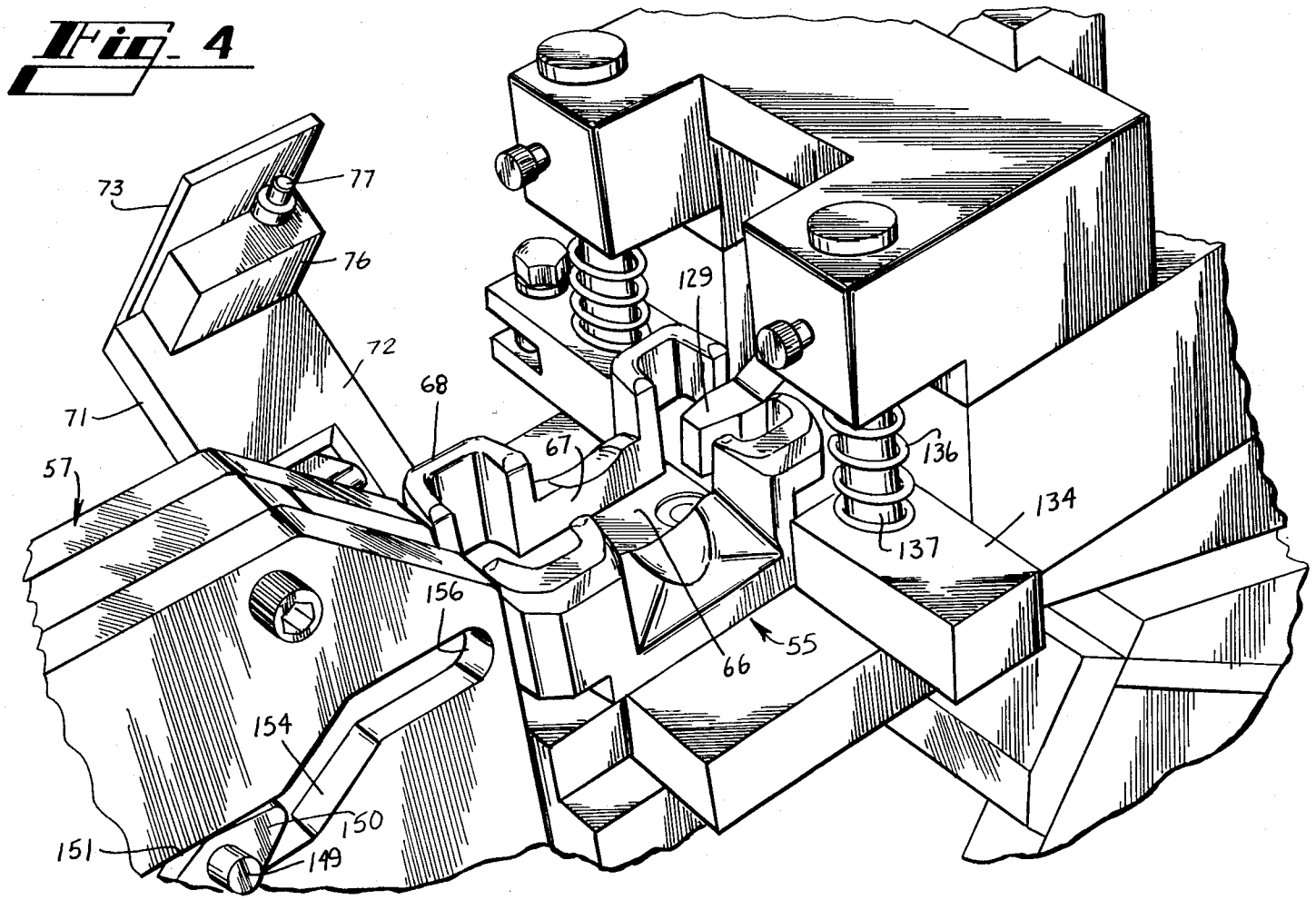
FIG. 4 is a perspective view of a portion of the apparatus of FIG. 1 to show a nest for holding the coupler housing while the contact elements are formed therein.
Figure 8:
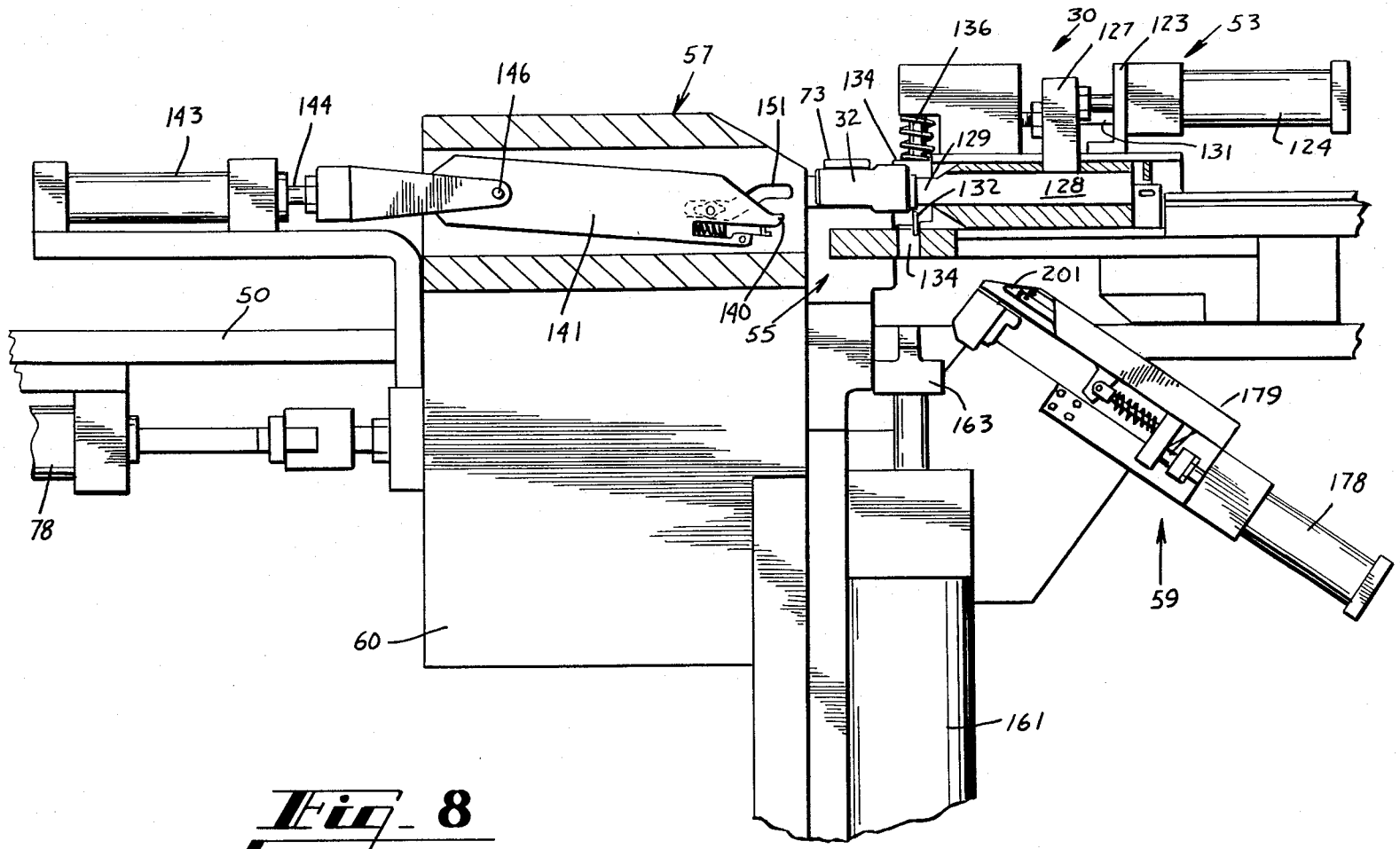
FIG. 8 is an elevational view of a portion of the apparatus which is shown in FIG. 1 to show the nest and tooling which is used to form ends of the wires.
Figure 9:
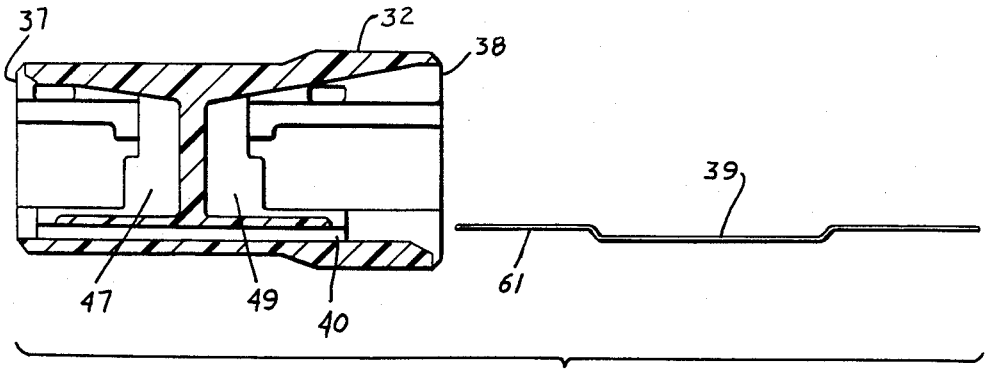
FIGS. 9–10 are a sequence of views showing the feeding of lengths of wire into the housing.

Referring now to FIGS. 4 and 8 there is shown a detailed view of a portion of the facilities 53 for guiding the wires into housing 32, as well as the nest 55 for holding the plastic housing. The nest 55 which is mounted on the carriage 60 includes a bed 66 having side members 67—67 with posts 68—68 extending upwardly therefrom. The nest 55 is designed so that when the coupler housing 32 is received therein, the housing ends extend to the beginning of each of the posts 68—68 at the ends of the nest. The nest 55 also includes a clamp 71 which is pivotally mounted on a frame of the next. The clamp 71 includes a member 72 having a member 73 extending at right angles therefrom. The clamp also includes a block 76 having a ball plunger 77 attached to one end thereof.

After the operator inserts the housing 32 into the nest 55, the clamp 71 is caused to be moved rotatably to secure the housing within the nest 55. As the member 73 is brought into juxtaposition with the housing 32, the ball plunger 77 engages the housing 32 along its side and causes it to be disposed within the nest so that passageways 40—40 of the housing are aligned with grooves within the guiding facilities 53. Then an air cylinder 78 (see FIG. 1) is controlled to cause the carriage 60 to be moved to the right to cause the nest to be adjacent to the guiding facilities 53.

Figure 6:
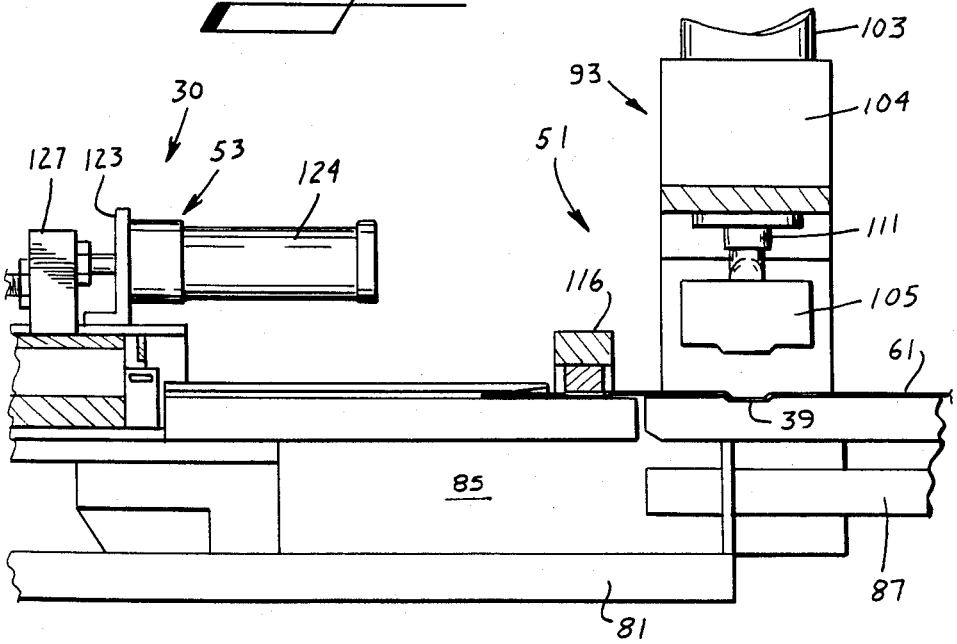
FIG. 6 is a side elevational view of the feeding portion of the apparatus of FIG. 1.
Figure 5:
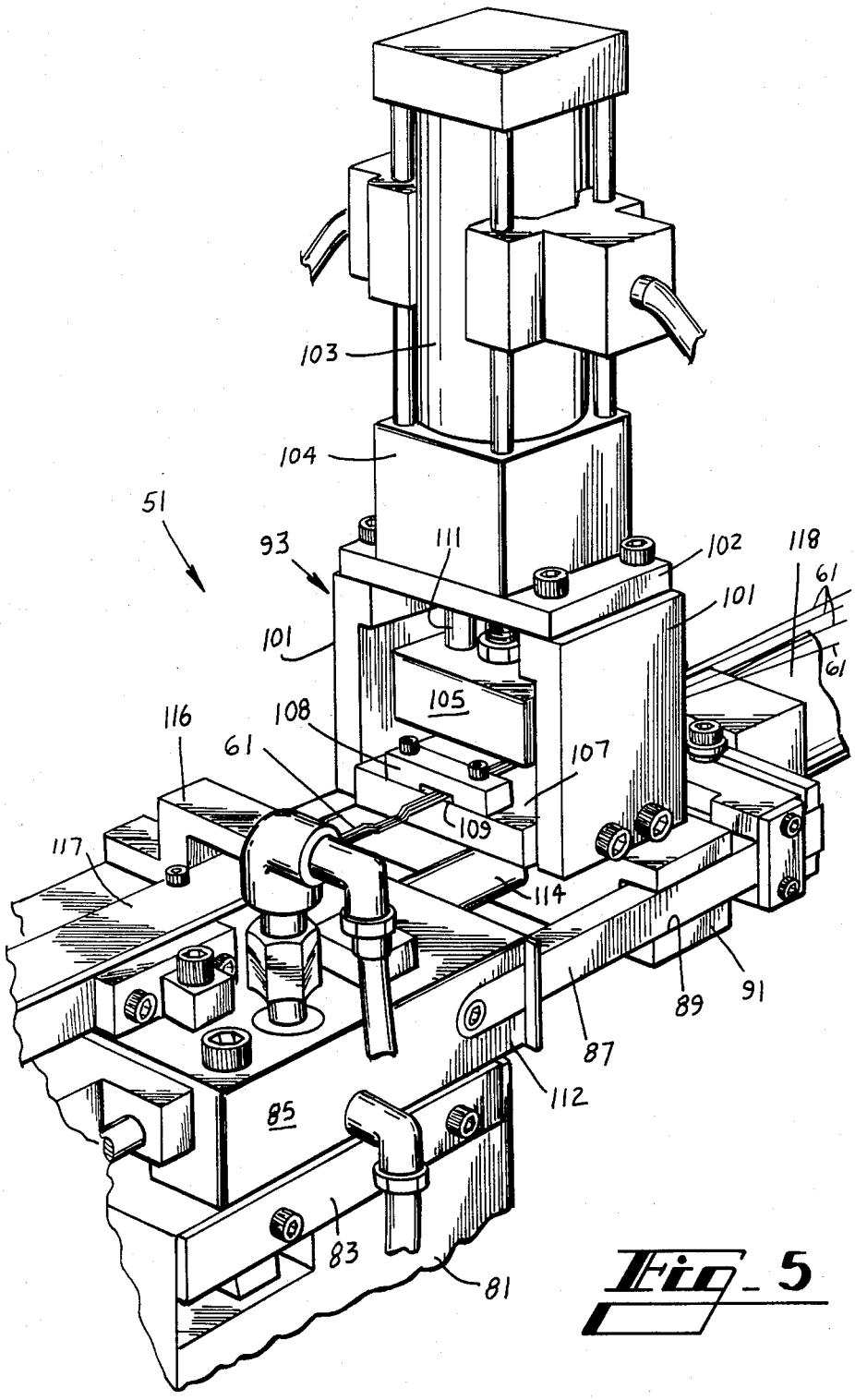
FIG. 5 is perspective view of a portion of the apparatus for feeding a plurality of wire lengths and for forming offsets into each of the lengths prior to their assembly with the plastic housing.

Going now to FIGS. 5 and 6, there is shown in detail the feeding portion 51, as well as portions of the wire guide facilities 53. As can be seen, the feeding portion 51 is mounted on a base 81 that is supported by the frame 50 and includes a support 83 for a controller 85. The feeding portion includes two ways 87—87, which extend to the right as viewed in FIG. 5 from the controller 85. Each of the ways 87—87 is received in a slotted end 89 of a cross member 91. The cross member 91 supports a punch and die device designated, generally, by the numeral 93.

The punch and die device 93 includes side members 101—101 which extend vertically and a top cross member 102 for supporting an air cylinder 103. The air cylinder 103 has a piston rod which extends through a block 104 and into fixed engagement with a moveable punch 105. The moveable punch 105 cooperates with a die 107 for forming the offset 39 in each of the four wires 61—61. The device 93 also includes a front guide member 108, having a plurality of slots 109—109 therein for maintaining the wires in spaced relation through the punch and die device.

As further can be seen in FIG. 5, the punch and die device 93 also includes two guide rods 111—111, which are disposed within bores in the punch 105 and extend upwardly into bores in the top cross member 102 in order to guide the moveable punch 105 into engagement with the die 107.

The punch and die device 93 is used to cause the offset 39 to be formed in each of a plurality of resilient, metallic wires 61—61, which are advanced by the feeding portion 51 of the apparatus 30 and which extend from supplies (not shown). As can be seen by viewing FIG. 3, the offset portion 39 of a length of each of the wires 61—61 is received in a passageway 40 which communicates the jack cavity in the customer end 37 of the housing 32 to the cavity in the end 38. The offset portion 39 of each wire is such that it and portions of the wire adjacent thereto engage opposite surfaces of a passageway 40 in which the wire is disposed.

The leading lengths of the wires 61—61 which form the contact elements 31—31 within the housing 32 in the nest 55 each have a diameter of 0.018 inch. In order to form the passageways 40—40 in the coupler housing 32, the passageways are enlarged to have a width of 0.026-0.028 inch and a height of 0.065 inch. Should the wires 61—61 not be formed with the offset portions 39—39, the lengths within the housing 32 would bow along their middle portions when their ends are formed into a retroflexed configuration. The bowing would prevent sufficient bending of the end portions to maintain the ends of the wires in a position to engage terminals of a plug when they are released. Also, it has been found that the closer the offset is to the ends of its passageway, the greater the support of the lengths of wire during the bending of its end portions and the less is the springback when the first forming tool 57 is withdrawn from the cavity at the customer end 37.

The offset 39 of each contact element 31 is important from another standpoint. Although not visible in the drawings, the corners of each passageway are formed with chamfered fillets. The distance between fillets along top and bottom surfaces of each passageway 40 is substantially equal to the diameter of a contact element 31. As a result, when a contact element is positioned in a passageway, the offset portion and parallel portions adjacent thereto are effective to maintain the contact element centered in the passageway.

Moving to the left in FIGS. 5 and 6, there is shown the controller 85 which is effective to control the feeding of the wires 61—61 to position them within the housing wherein their ends are formed. The controller 85 includes a housing 112 in which is disposed an air cylinder having a piston rod 114 extending to the right, as shown in FIG. 5, into engagement with the cross bar 91. A strap 116, which functions as a clamp is provided in the vicinity of the controller 85.

With the four wires 61—61 in position extending through the punch and die device 93 and through slots in a channel 117 above the controller 85, the operation of electronic circuitry (not shown) causes the air cylinder 103 to operate and to cause the punch 105 to cooperate with the die 107 to form the offsets 39—39 in the wires. The punch remains bottomed out with the die 107 and the controller 85 is rendered effective to release the clamping strap 116. Then, the controller 85 is caused to operate its air cylinder to retract the rod 114 to the left, as viewed in FIGS. 1 and 6, and move the cross-member 91 along with the punch and die device 93, along the ways 87—87. The movement of the rod 114 and the cross member 91 causes the wires to be advanced to the left to position their leading lengths within a housing 32 which is disposed in the nest 55. After the wires have been advanced by a predetermined distance, the punch 105 continues to hold the wires 61—61 in engagement with the die 107. At a subsequent point in the cycle of operation, the clamping bar 116 is operated to clamp the wires 61—61 within the guide slots above the controller 85 and the air cylinder 103 operated to move the punch upwardly and release the wires. At that time, the controller 85 is rendered effective to cause the air cylinder therein to extend its piston rod 114 to move the cross member 91 and the punch and die device 93 mounted thereon to the right as viewed in FIG. 5.

As can also be seen in FIG. 5, an air cylinder 118 is disposed to the right of the ways 87—87. This air cylinder 118 includes a piston rod which is connected to the cross member 91 and functions as a dampening mechanism to prevent an abrupt engagement of the cross member 91 and punch and die mechanism at the end of the stroke of the rod 114.

Figure 7:
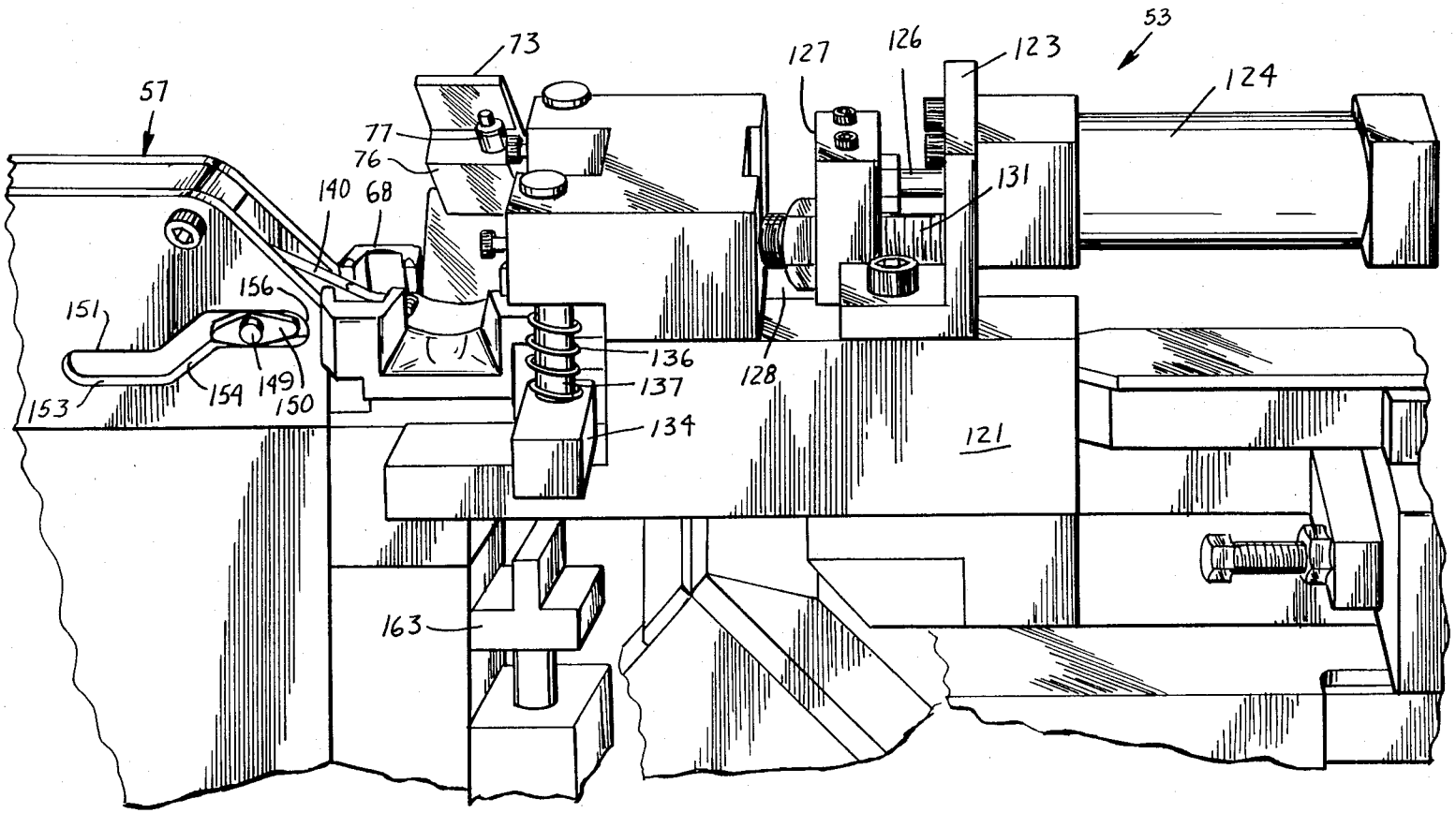
FIG. 7 is a perspective view of a portion of the apparatus which is used to hold a coupler housing and to guide lengths of wire thereinto.

Referring to FIGS. 7-8, it is seen that the guiding and cutting portion 53 of the apparatus 30 includes a support block 121 that is supported on the frame 50. Extending upwardly from the block 121, and connected thereto, is an L-shaped bracket 123 for supporting an air cylinder 124. The air cylinder 124 has a rod 126 extending therefrom and connected to a vertical block 127. The vertical block 127 attaches to a slide 128 having a nose end 129 attached thereto.

Figure 10:
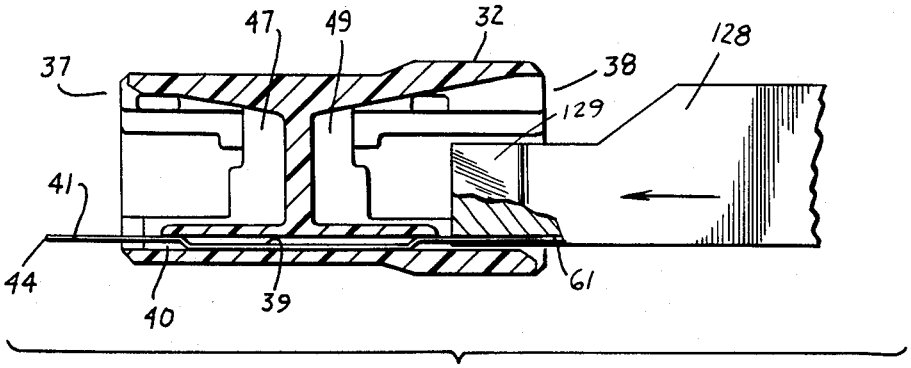

After a housing 32 has been positioned in the nest 55 and clamped therein, its passageways 40—40 are aligned with the four wires 61—61 that extend through the feeding portion 51 and through the guiding facilities 53 (see FIG. 5). The operation of the air cylinder 124 is controlled to extend the rod 126 and move the block 127 and the slide 128 to cause the nose end 129 to be moved into the cavity at the locked plug end 38 of the coupler housing 32 (see FIG. 10). The nose guide 129 provides a guide for the wires 61—61 as they are being fed by the feeding portion 51 so that they are moved into the passageways in the housing without any length thereof being unsupported. Leading end portions of the lengths of wire in the housing extend through the cavity at the housing end 37 and are destined to become the retroflexed end portions 41—41 of the contact elements 31—31. The portions of the wires 61—61 within the cavity at the housing end 38 are destined to become the retroflexed end portions 43—43.

The guiding portion 53 which includes the movable slide 128 also includes an adjustable stop 131 (see FIG. 7) which engages the vertical portion of the bracket 123 to control the return of the nose guide 129 after leading lengths of the wires have been positioned within the housing 32. The positioning of the nose guide 129 after it has been withdrawn from the housing 32 must be precise in order to control the cutoff point of the leading lengths of the wires 61—61 in the housing from their supplies. The nose guide 129 also functions as an anvil during the cutoff operation when it cooperates with a knife 132 (see FIG. 11) which is attached to one side of a vertically movable bar 134 which is biased downwardly by springs 136—136 disposed about rods 137—137.

In the normal unoperated position, the bar 134 is disposed somewhat below the nest 55 to permit the nose guide 129 to be moved between posts 68—68 at the right end of the nest and into the housing 32. After the nose guide 129 has been withdrawn from the housing, and after the left-hand ends of the wires within the cavity at the customer end of the housing have been formed, the bar 134 is moved upwardly to cause the knife attached to the right-hand side, as viewed in FIG. 11, to cooperate with the anvil 129 to sever the wires 61—61 from their supplies.

Figure 11:
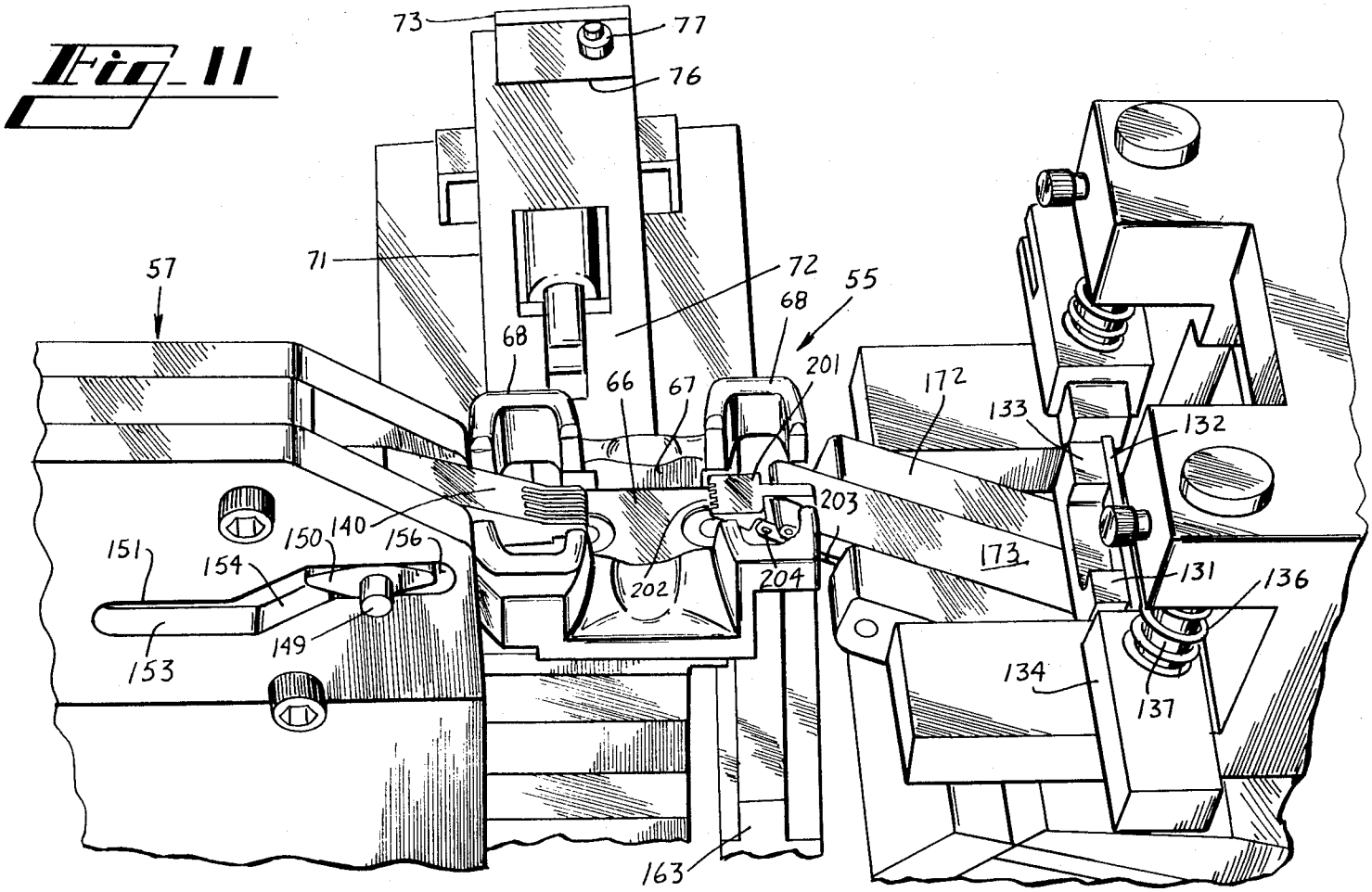
FIG. 11 is a perspective view of a portion of the apparatus to show the relation of forming tools to the nest.

Going now to FIGS. 1, 8 and 11, which show the the first forming tooling 57, it is seen that a right-hand end of a tool 140 projects from a slide 141 which is moved by an air cylinder 143. The left-hand end of the slide 141 is connected to a piston rod 144 of the cylinder 143 by a pin 146 which rides in a longitudinally disposed slot 148. The right-hand end of the first forming tool 57 has a pin 149 extending therefrom. The pin 149 which is held in a triangular key 150 is received in a camming slot 151 which includes a first horizontal portion 153, an inclined portion 154, and a second horizontal portion 156. As can be seen in FIG. 1, the second horizontal portion 156 of the slot 151 is aligned with the longitudinally disposed slot 148.

As the forming tool 140 is moved to the right, the pin 149 begins to ride up the inclined portion 154 of the slot 151. Also, the leading end of the tool 140 engages the lower portions of each of the wire ends which after the feeding step extend about 0.3 inch beyond the customer end 37 of the housing 32 (see FIG. 12). It is important to recognize that the initial engagement of the forming tool 140 with the extending wires is accomplished with the free end of the tool being disposed beneath the wires. Then the slide 141 pivots about its connection to the air cylinder 143. The movement of the pin 149 along the cam slot 151 causes the tool 140 to bend each of the end portions 41—41 of the lengths of wire 61—61 in the housing 32 into a retroflexed configuration (see FIG. 13). Then as the tool 140 is moved farther by the air cylinder 143, the pin 149 rides along the horizontal portion 156 of the slot and the tool end becomes disposed above the leading end portions of the wires 61—61 (see FIG. 14). Then as the tool end is cammed upwardly, the wires which are received between the walls of the slots are bent into a generally U-shaped retroflexed configuration. Subsequently, after the wire ends in the locked plug end of the housing 32 have been formed, the first forming tool 140 is withdrawn to allow the retroflexed end portions of the wires to move pivotally about their radiused portions and into the predetermined retroflexed configuration shown in FIG. 3.

After the wires have been formed in the customer end 37, the forming tool 140 remains in position and is disposed above the free end portions thereof. The slotted end of the first forming tool maintains the lateral alignment of the wires.

Figure 12:
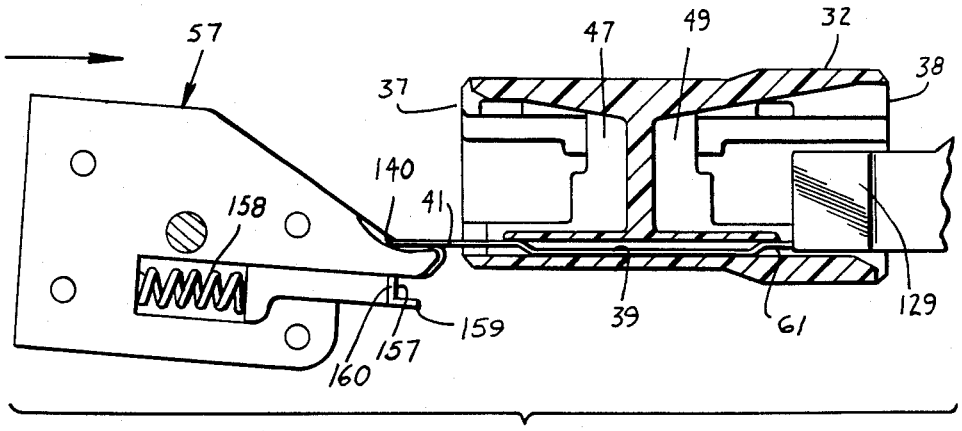
FIGS. 12–14 are a sequence of views showing the forming of end portions of the wires in a customer end of the housing.
Figure 13:
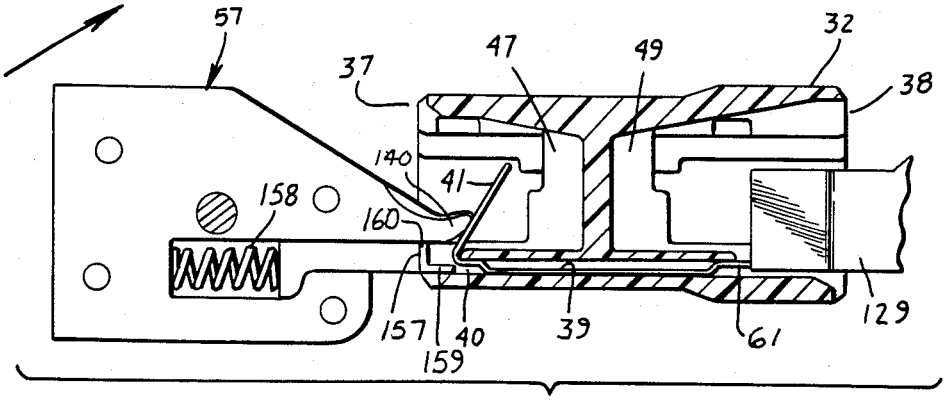

As can be seen in FIG. 12, the forming tool 140 includes a plurality of L-shaped fingers 157—157 which are biased to the right by a spring 158. Horizontal portions 159—159 of the fingers become disposed beneath the wires 61—61 between the offset portions 39—39 and the radiused portions and extend into the passageways 40—40 of the housing 32. Vertical portions 160—160 engage the radiused portions of the end portions of the wires in the cavity at the housing end 37.

The fingers 157—157 perform several important functions. The vertical portions 160—160 support the wires within the housing 32 against inadvertent longitudinal movement during the step of forming the end portions in the cavity at the housing end 38. Also, the vertical portions 160—160 are effective to maintain the radiused portions of the wires in engagement with the plastic housing at the ends of the passageways during the step of severing the wires from the supplies.

Figure 14:
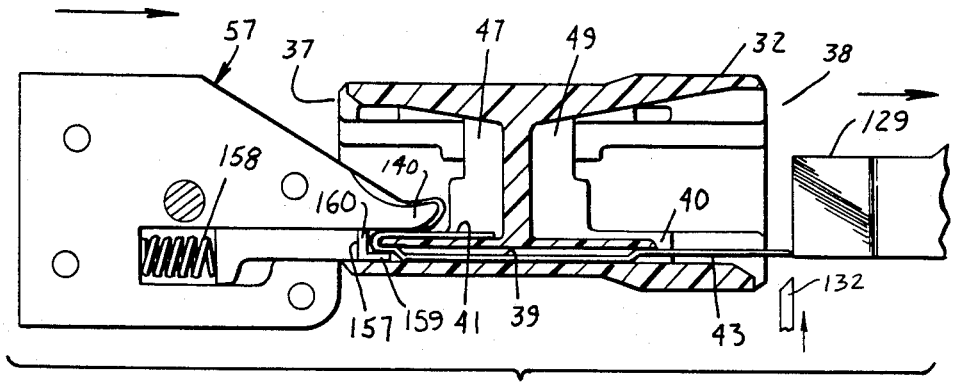

Another function relates to the so-called springback of the wire end portions after the tooling 57 is withdrawn from the position shown in FIG. 14. Because of their resilience and because of the controlled manner in which forces are applied to form the wires, the end portions of the wires move pivotally or spring back into a position where they are angled to the center portions. By providing support adjacent to the customer end portions 41—41 of the contact elements with the horizontal portions 159—159 of the fingers 157—157 during the forming of them into a retroflexed configuration, the wire system is sufficiently stiff to control the deflection of the wire between the offset portions and the radiused portions. As a result, when the tool 140 is withdrawn from the customer end cavity, less springback is experienced by the end portions. The control of the deflection provides the capability of causing the end portions 41—41 to move pivotally about their radiused portions into a predetermined retroflexed configuration.

The offset 39 in each wire is also helpful in providing support of the wire during the bending step. The amount of support is a function of the amount of offset and the distance between the offset and each radiused portion. As the offset is moved closer to a radiused portion, the springback of the associated end portion is reduced upon withdrawal of the tool 140 and of the tooling 59.

Following the formation of the wires 61–61 in the customer end, the apparatus 30 is controlled to sever the partially formed contact elements 31—31 from the supplies. An air cylinder 161 (see FIGS. 1 and 8) which is disposed beneath the apparatus 30 and which is mounted on the carriage 60 is controlled to cause its piston rod to be extended and to cause a T-shaped member 163 to engage a lower surface of the bar 134. It will be recalled that the bar 134 includes a dished-out center portion and a knife blade 132 (see FIG. 11) which is attached to one side 133 of the bar. The blade 132 spans the dished-out portion and is adapted to cooperate with the nose end of the guide 129 to sever the wires and form trailing ends (see FIG. 14).

After the wires 61—61 have been sheared, the carriage 60 is moved to the left as viewed in FIG. 1. This is necessary in order to allow room for the second forming tooling 59 to be moved into the cavity at the locked plug end 38 to form the wires therein.

Figure 16:
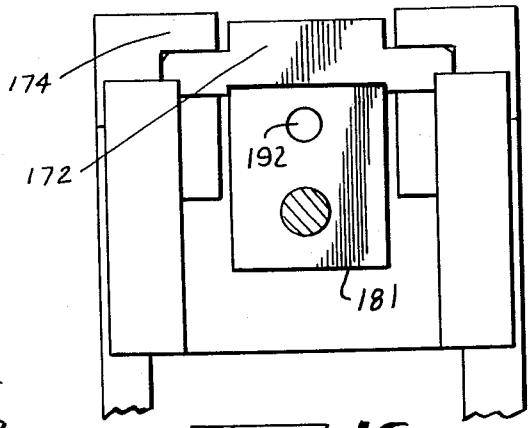
FIG. 16 is an end view of the forming tooling of FIG. 15 and taken along line 16—16 thereof.
Figure 15:
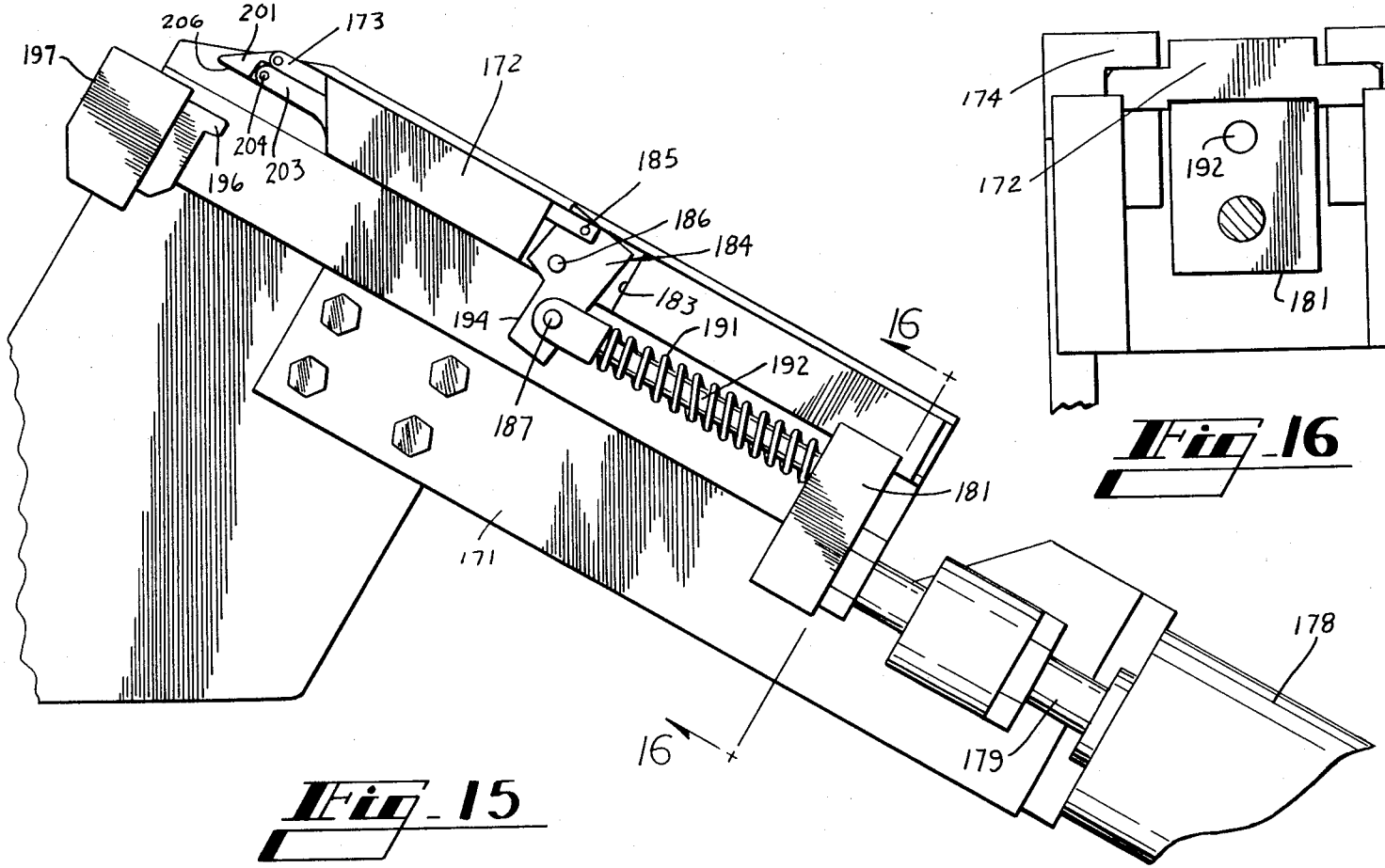
FIG. 15 is a side elevational view of tooling for forming the end portions of the wires in a locked plug end of the housing.

Referring now to FIGS. 1, 8 and 11, it can be seen that the second forming tool 59 is disposed at an angle of about 30° to the horizontal. The tooling 59 includes a frame 171 (see FIG. 15) for supporting a stepped main slide 172 and a center slide 173. An overhang 174 (see FIG. 16) provides support for each side of the stepped slide 172. The center slide 173 is slidably mounted in a groove in a left-hand end of the slide 172 as viewed in FIG. 15. An air cylinder 178 has a rod 179 that is connected to an end wall 181 that is keyed into an underside of the slide 172.

Figure 17:
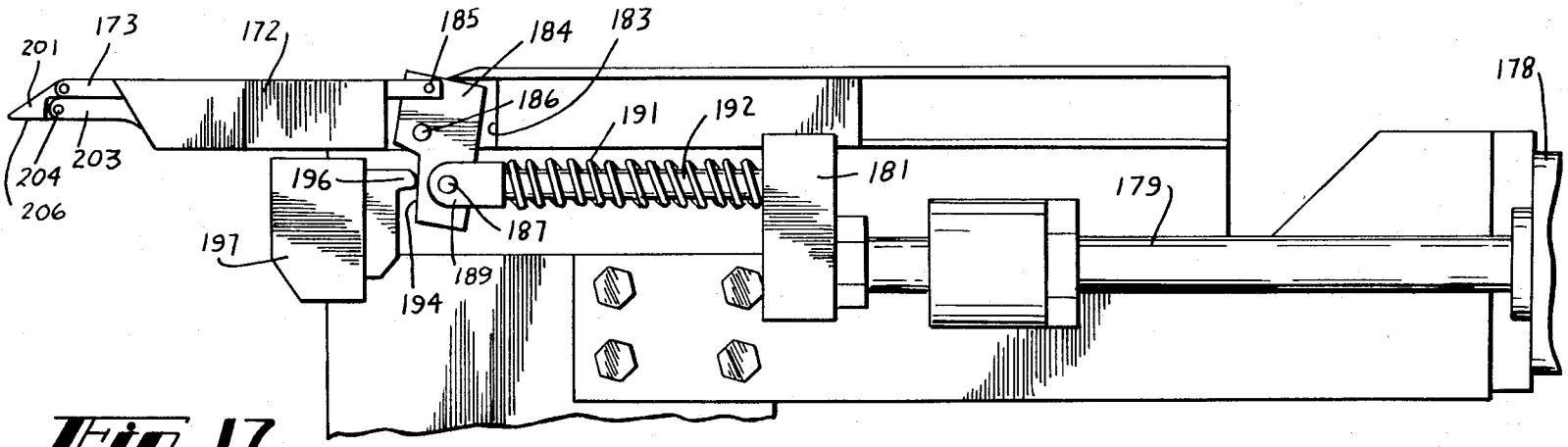
FIG. 17 is an elevational view of the tooling of FIG. 15 taken in section.
Figure 18:
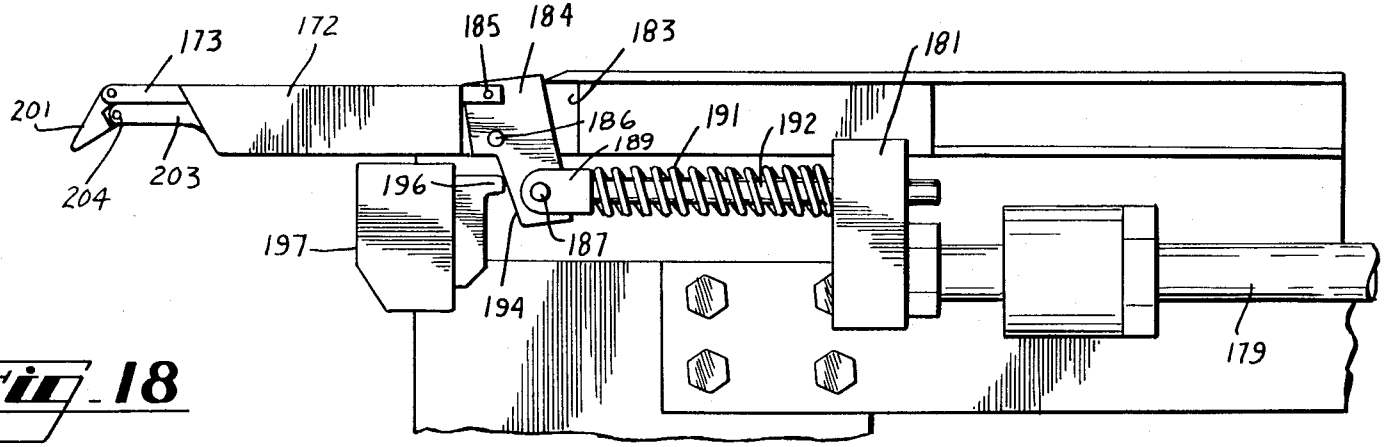
FIG. 18 is an elevational view of the tooling of FIG. 15 after its articulated end portion has been operated.

Viewing now FIGS. 17–18 it can be seen that the main slide 172 includes an opening 183 in which is disposed a pivotally mounted rocker arm 184. The rocker arm 184 is mounted pivotally about an axis 186 which extends between side portions of the main slide 172. Secondly, the rocker arm has a pin-connection 185 to the center slide 173. Also, as can be seen, the arm 184 is pinned at a point 187 to a link 189 which is biased to the left by a spring 191 that is disposed concentrically about the a rod 192. The rod 192 extends through an opening in the end wall 181.

The main and center slides 172 and 173, respectively, are arranged so that the two are caused to advance together to the left and upwardly toward the locked plug end 38 of the coupler housing 32 in the nest 55. Their joint motion continues until a surface 194 of the rocker arm 184 engages a protruding portion 196 (see FIGS. 17–18) of a stop 197. This causes the arm 184 to be moved pivotally about its axis 186 and to wrap about the protruding portion 196. This overcomes the bias of the compression spring 191 and causes the center slide to move relative to the main slide 172 which is still moving at this point.

Figure 19:
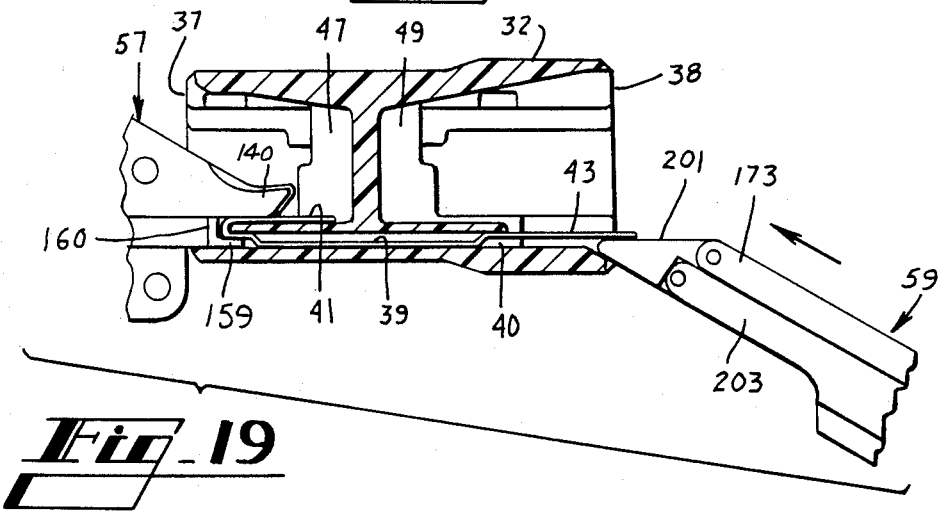
FIGS. 19–22 are a sequence of views showing the forming of end portions of the wires at the locked plug end of the housing and the movement of end portions of the wires after tooling has been withdrawn from the housing.
Figure 20:
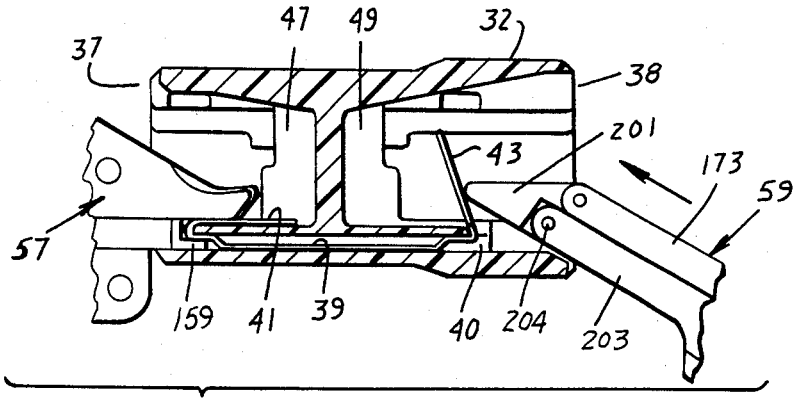
Figure 21:
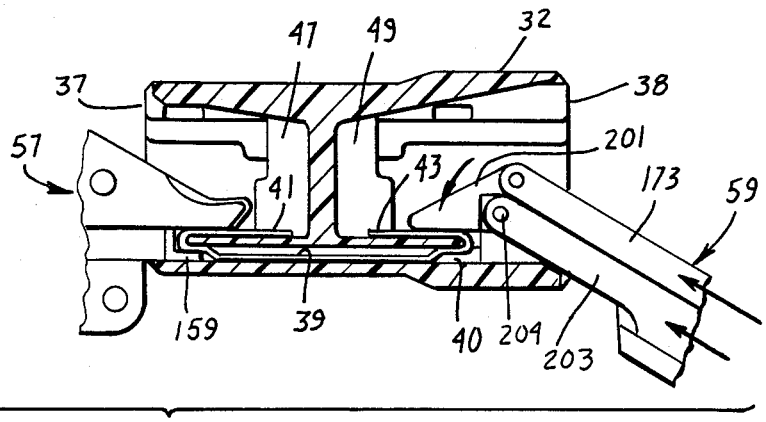

The above-described mechanical movement is important to the capability of forming the retroflexed ends 43—43 of the wire lengths in the locked plug end. The end of the second forming tool 59 includes an articulated portion 201 having a plurality of slots 202—202 formed therein (see FIG. 11). The articulated portion 201 is received between narrowed extensions 203—203 of the main slide 172 and is pinned thereto along an axis 204. Also, one end of the articulated portion 201 is pinned to the center side 173. As the second forming tool 59 is moved upwardly to the left as viewed in FIGS. 8 and 19, the articulated end 201 has a lower surface 206 generally coplanar with the underside of the extension 203—203. It engages the trailing ends portions of the wire lengths in the housing 32, as can best be seen in FIG. 19, and begins to turn the trailing end portions thereof (see FIG. 20). Then the rocker arm 184 engages the stop 197 while the main slide 172 continues its upward motion thereby causing the rocker arm to pivot. The rocker arm 184 pivots and causes the center slide 173 to move upwardly to the left relative to the slide 172. This causes the articulated portion 201 to be moved pivotally about the axis 204 which causes the trailing end portions of the wire lengths to be formed into U-shaped configurations with their ends between the partitions of the housing (see FIG. 21).

Following this forming step, the air cylinder 178 is controlled to move the end wall 181 to the right as viewed in FIG. 18 and to disengage the rocker arm 184 from the stop 197. This allows the spring 191 to be rendered effective to move the rocker arm 184 pivotally in a clockwise direction. Because the rocker arm 184 is pin connected to the center slide 173 at a joint 185, the clockwise motion causes the center slide to be moved to the right to cause the articulated end to be disposed with its side 206 generally planar with the underside of the extensions 203—203.

Figure 22:
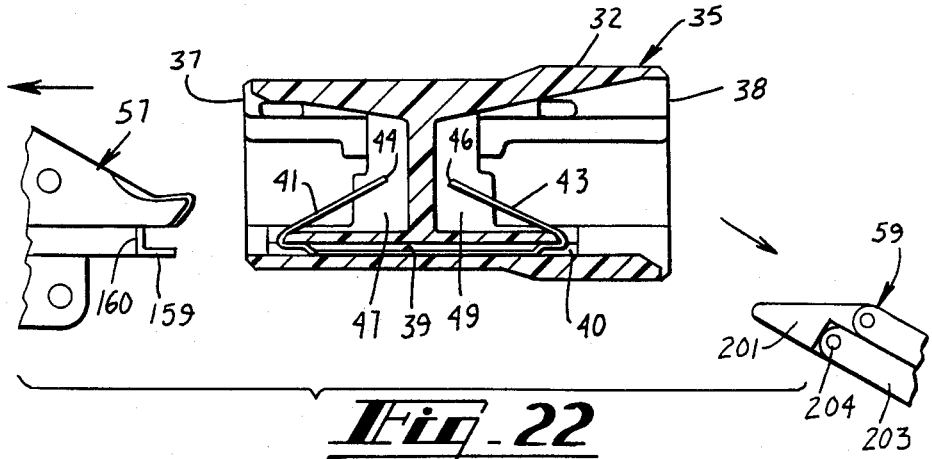

The first forming tool 140 is moved to the left, out of the customer end cavity (see FIG. 22), and the clamping bar 116 (see FIG. 6) is moved downwardly to engage the wires extending to the supplies. At that time, the punch 105 is raised and the punch and die device 93 is moved to the right, as viewed in FIG. 1. The guide member 108 allows the offset portions 39—39 of the wires 61—61 to pass through the slots 109—109 therein without disturbing the lateral alignment of the wires. Then the second forming tooling 59 is retracted (see again FIG. 22), whereupon the spring 191 is effective to move the rocker arm 184 pivotally in a clockwise direction to cause the center slide 173 to move relative to the main slide 172 and cause the articulated end 201 to assume its initial orientation, as depicted in FIG. 17. The clamp 71 is moved pivotally to become disengaged from the housing 32 and the operator removes the assembled coupler 35 from the nest 55.

The tooling 57 has a dual function—it not only forms the wires in the customer end 37, but it also acts as an anvil to hold the wires 61—61 in their positions when the wires are cut off from the supplies and formed at their other ends. It will be recalled that during the forming of the wire ends in the locking plug end 38, the first forming tool 57 is still in position in engagement with the wire ends in the cavity in the customer end 37 (see FIG. 19). As a result, each trailing end portin of a length of wire in the locked plug end 38 is stiffer and less springback of the trailing end portions therein is experienced after withdrawal of the tooling. Also, as will be recalled, the fingers 157—157 at the end of the first forming tool are spring-biased into engagement with the wires. This prevents inadvertent movement of the wires during the shearing step and during the forming of the trailing end portions.

In another embodiment of the invention, a hand tool and supporting devices are used to form wires into contact elements within the housing. A nest 211 (see FIG. 23) is provided for receiving the customer end of the coupler housing 32 to facilitate hand-loading of preformed wire-like contact elements 31—31. The nest 211 includes a plate 213 having a cavity 214 formed therein. The cavity 214 is configured to accept the customer end 37 of the housing 32. The cavity 214 includes two opposed subcavities 216—216, each of which is aligned with the passageways of the housing when the customer end of the housing is disposed in the cavity 214.

An operator inserts the customer end of the housing 32 in the cavity 214 and then loads a preformed contact element 31 into each of the passageways. Each preformed contact element 31 includes the offset portion 39 and the retroflexed end portion 43. The contact elements 31—31 are loaded to engage their ends to abut the floors of the subcavities 216—216 to cause them to be parallel to one another and to cause the retroflexed end portions 43—43 to be disposed in the end 38 but outside the partitions 49—49.

Then, the operator moves the housing 32 to cause an anvil tool 221 (see FIG. 24) to be received in the cavity at the locked plug end 38 of the housing. The anvil tool 221 is supported from a bifurcated frame 222 that is attached to a post 224 that is supported in a spherical bearing 226 held in a support 228. In this way, by loosening a nut 229, the bearing 226 and post 224 may be turned to cause the anvil tool to have a predetermined orientation.

The anvil tool 221 has a free end portion 231 which is made of plastic and which is designed to be received in the cavity at the locked plug end 38 of the housing 32. The free end portion 231 is bifurcated to hold a plurality of metallic blade-like members therebetween. As will be recalled, the coupler 35 at each end includes three partitions and four metallic contact elements 31—31 with the retroflexed end portion of each element received between two of the partitions or between a partition and a wall of the cavity. The anvil tool 221 includes four metallic anvil members 233—233 which depend below the bifurcated end 231 and which are aligned with the contact elements 31—31. It, also, includes three metallic members 234—234, each being aligned with a partition and interposed between two anvil members. When the anvil end of the tool is received in the locked plug end 38 of the housing, each of the anvil members 233—233 engages a radiused end of one of the contact elements and acts to support that contact element against displacement as its opposite end is being formed.

Figures 23, 24, 25:
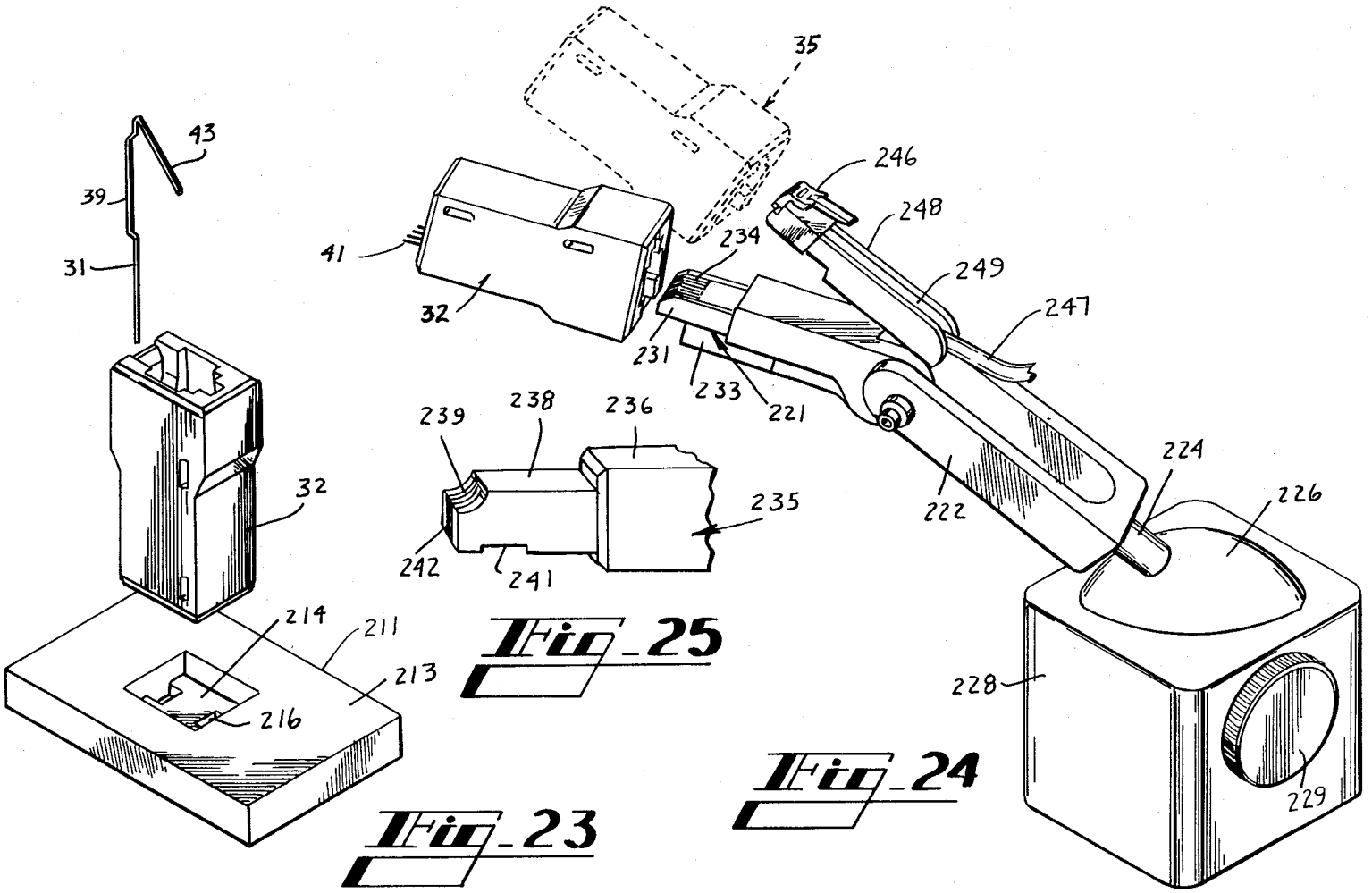
FIG. 23 is a perspective view of a nest which is used in a manual assembly of the coupler.
FIG. 24 is a perspective view of an anvil tool which is used in the manual assembly of the coupler.
FIG. 25 is a perspective view of a hand tool which is used to form end portions of wires in one end of the coupler housing.

Next, an operator, while the coupler is supported by the inserted anvil end, uses a hand tool 235 (see FIG. 25) to form the ends 41—41 of the contact elements 31—31 in the customer end into a retroflexed configuration. As can be seen in FIG. 25, the hand tool 235 includes a handle 236 and a free end portion 238, which is made of plastic and which is adapted to be received in the cavity of the customer end. The free end portion 238 includes a chamfer 239 on one side. On the other side is formed an undercut or lip 241. Adjacent to the undercut 241 are formed a plurality of slots 242—242, each of which is designed to receive a contact element 31.

Figure 26:
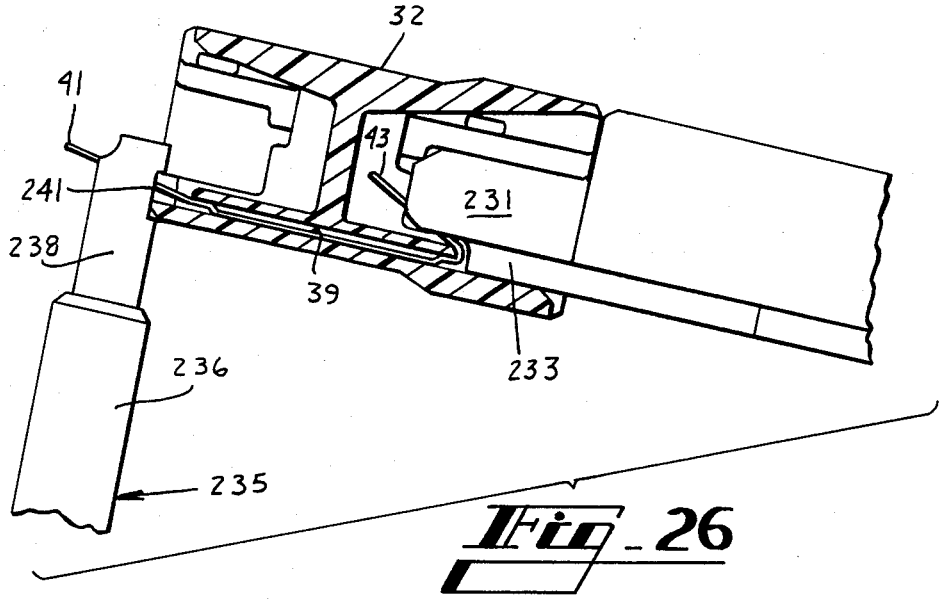
FIGS. 26–28 are a sequence of views to show the manual forming of the end portions of the wires at the customer end of the housing.
Figure 27:
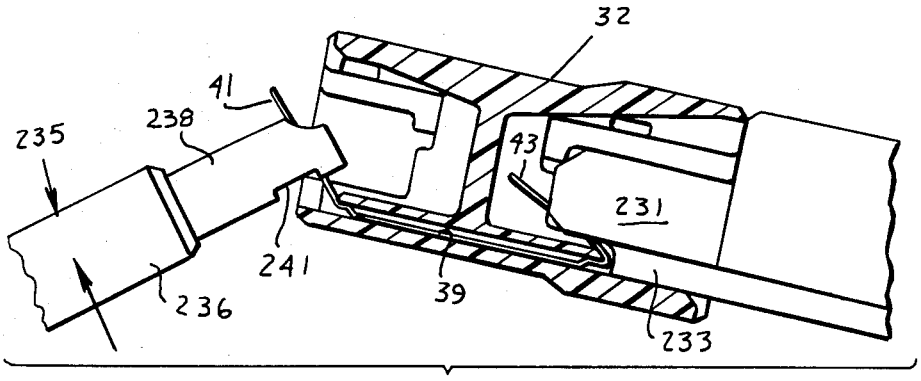
Figure 28:
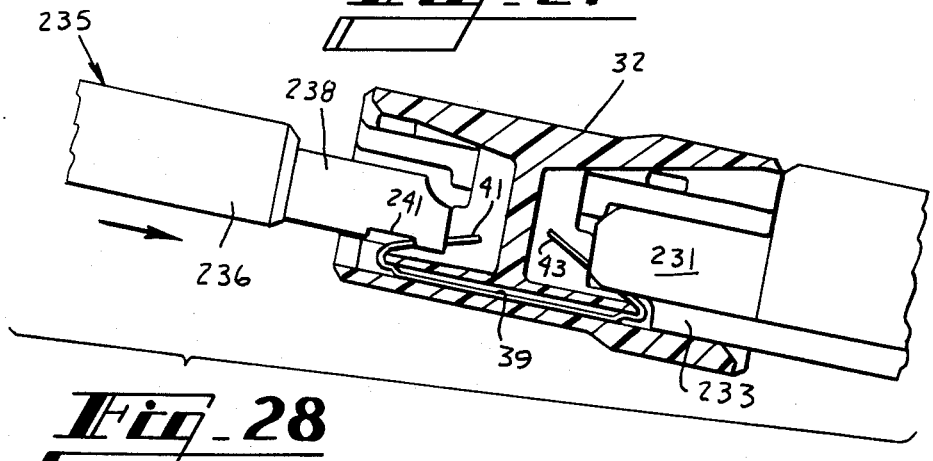

In forming the ends 41—41 of the contact elements, an operator grasps the hand tool 235 and causes the top of the undercut 241 to engage the bottom of the cavity wall of the coupler housing 32 at the customer end 37 with each contact element 31 which is extending beyond the coupler being received in one of the slots 242—242 (see FIG. 26). Then, the operator moves the tool 235 pivotally about its line of engagement with the cavity wall to cause the end portions of the contact elements 31—31 to be turned (see FIG. 27). As the operator continues to pivot the free end portion 238 of the tool, the operator causes it to be moved into the cavity whereupon the slots 242—242 become aligned with the spaces between the partitions in the housing (see FIG. 28). This causes the end portions of the contact elements 31—31, which are now in a retroflexed configuration, to be received between the partitions.

The configuration of the end portions 41—41 of the contact elements 31—31 is a function of the location and of the depth of the undercut 241. As should be apparent from FIG. 28, the deeper the undercut, the greater is the angle of inclination of the end portions 41—41 to the center portions of the contact elements 31—31. Also, the closer the undercut 241 is to the open ends of the slots 242—242, the smaller is the angle of inclination.

After the contact elements 31—31 have been formed in the housing 32, the anvil tool 221 is used to assemble a modular plug 246 at one end of a stranded line cord 247 to the coupler 35. The plug 246 is positioned at an end of a channel bar 248 with the cord being disposed in a groove 249 through the channel bar. Then the coupler 35 is moved to cause the modular plug 246 to be received in the end 38 of the housing 32 and to become locked therein.

It is to be understood that the above-described arrangements are simply illustrative of the invention. Other arrangements may be devised by those skilled in the art which will embody the principles of the invention and fall within the spirit and scope thereof.

What is claimed is:

1. A method of forming a wire-like contact element within a plastic housing with a center portion of the contact element being disposed in a passageway having opposie surfaces which communicates with plug-receiving cavities at opposite ends of the housing, said method including the steps of:

preforming a center portion of a length of resilient metallic wire to include a portion which is offset sufficiently from an axis through ends of the length of the wire to cause the offset and adjacent portions of the wire to engage said opposite surfaces of the passageway in which the center portion of the wire is to be disposed;

moving the length of wire into the housing to cause a first end portion of the wire to be disposed in the cavity at one end of the housing and a second end portion of the wire in the cavity at the opposite end of the housing, and to cause the center portion of the wire to be disposed in the passageway with the offset portion of the wire being positioned adjacent to the portion of the wall of the passageway opposite the wall adjacent to the associated cavities in the housing;

applying lateral support to a portion of the wire contained in the passageway between the first end portion of the wire and the offset portion of the wire and adjacent to the offset portion of the wire to hold that portion of the wire, against which support is provided in engagement with the wall of the passageway adjacent to the one cavity at the one end of the housing while the one end of the wire is being bent into a retroflexed configuration;

causing the first and second end portions of the length of wire to be formed into a retroflexed configuration by applying forces in a controlled manner to the length of wire between its offset portion and its ends, the application of forces in a controlled manner being effective to allow the end portions of the resilient wire to move pivotally into predetermined neutral positions when the application of forces is discontinued.

2. The method of claim 1, wherein the forces which are applied to the wire cause each end portion of the wire initially to have a generally U-shaped configuration, and said method includes the step of applying lateral support to the portion of the wire length contained within the passageway between the offset of the wire and the first end portion of the wire during the step of causing the first end portion of the wire to be formed into the U-shaped configuration to control its deflection and cause the first end portion of the wire to move pivotally into a predetermined neutral retroflexed configuration when the application of forces is discontinued.

3. The method of claim 1, wherein, prior to causing the second end portion of the wire to be formed into a retroflexed configuration, the first end portion of the wire is supported to prevent inadvertent longitudinal movement of the wire, and wherein during the forming of the second end portion of the wire into a retroflexed configuration, force is applied to the second end portion of the wire at an angle transversely of the second end portion of the wire and the axis of the associated passageway in one direction and then in reverse directions.

4. A method of forming a plurality of wire-like contact elements within a plastic housing, with a center portion of each contact element being disposed in a passageway having opposite surfaces which communicates with plug-receiving cavities at opposite ends of the housing, said method including the steps of:

preforming each of a plurality of lengths of resilient metallic wire to include at least one offset portion along a center portion thereof, the offset of each length of wire being spaced from adjacent portions of the associated length of wire to cause the offset portion of the length of wire and portions of the length of wire adjacent to the offset portion of the length of wire to engage said opposite surfaces of the passageway in which the length of wire is to be disposed;

inserting the preformed length of wire into one end of the housing with the offset portion of each length of wire being disposed in one of the passageways, with an end portion of each length of wire being received in the associated cavities at ends of the housing;

causing one end portion of each of the lengths of wire to be retroflexed and form one leg of a generally U-shaped configuration in the associated cavity at the adjacent end of the housing by applying forces to bend the one end portion of the length of wire; while supporting each portion of the associated wire forming the base and opposing leg of the U-shaped configuration to prevent deflection of the supported portion of the length of wire; then applying force to the opposite end portion of each length of wire which extends into the associated cavity at the opposing one end of the housing; while continuing to support the U-shaped portion of the portion of each retroflexed first end portion in the cavity at the opposite end of the housing to prevent inadvertent movement of length of wire;

continuing to apply such force to bend the engaged opposite end portion of each length of wire into a retroflexed generally U-shaped configuration in the cavity at the associated end of the housing and beyond the desired neutral position of the opposite end of the wire;

discontinuing the application of forces to each of the opposite end portions of the lengths of wire to allow each of the opposite end portions of the lengths of wire to move laterally into a predetermined neutral retroflexed configuration and form a predetermined angle between the axis of each of the center portions of each of the lengths of wire.

5. The method of claim 4, wherein the lengths of wire are leading end portions of a plurality of wires of indefinite length and said method also includes the steps of;

supporting the housing in a predetermined position;

moving leading ends of the lengths of wire into the cavity at the one end of the housing and into alignment with the associated passageways;

feeding the leading ends of the lengths of wire through the associated passageways in the housing to cause a leading end portion of each of the lengths of wire to be disposed at the opposite end of the housing; and severing the length of each of the wires which is disposed within the housing from the associated indefinite length thereof to form a trailing end in each length of wire with each trailing end being disposed in the cavity at the one end of the housing.

6. The method of claim 5, which includes the step of forming of the offset in each of the plurality of indefinite lengths of wire prior to feeding the leading portions of each of the lengths of wires into the housing.

7. The method of claim 5, wherein the step of bending the first end portions is accomplished with a tool having a slotted end which is moved from a first path generally parallel to the axes of the passageways, in to an inclined path to bend the first end portions between the first end portion of each wire length and the housing, and then to a second path generally parallel to the axes of the passageways to hold the first end portions of the wires generally parallel to the passageways.

8. The method of claim 5, wherein a portion of the tool used to form the first end portion of each wire extends into each passageway and is positioned between the wall of the passageway and a portion of each of the wires extending from each offset portion of the wire and the adjacent end of the associated passageway to provide support for that portion of each of the wires against deflection and another portion of the slotted tool engages the U-shaped portion of each first end portion of each of the wires to prevent inadvertent longitudinal movement of the wires during the step of severing and the step of bending the opposite end portions of the wires.

9. The method of claim 5, wherein said step of engaging each of the opposite end portions of the wires is accomplished by applying the force at an angle to the axes of the center portions of the wires to cause the opposite ends of the wires to be retroflexed and then transversely to the axes of the portions of the wires in the passageways to cause each of the opposite end portions to be bent into a U-shaped configuration until the retroflexed opposite ends of the wires extended in a line substantially parallel to the axes of the passageways.

10. A method of forming a plurality of wire-like metallic contact elements within a plastic housing with a center portion of each of the elements extending through a passageway having opposite sides and with end portions of each of the elements being disposed in cavities at opposite ends of the housing, said method including the steps of;

preforming each of a plurality of lengths of resilient wires to have an offset portion along a center portion thereof, the offset portion of each length of wire being spaced from an axis between its ends to cause the offset portion of the length of wire and portions adjacent to the offset portion of the length of wire to engage opposite surfaces of a passageway in which it is to be disposed;

moving each of the plurality of lengths of wire into one end of the housing and causing the lengths of wire to be disposed in the housing with the offset portions thereof being disposed in the passageways;

holding each of the lengths of wire in the housing to prevent inadvertent lateral and longitudinal movement thereof;

causing one end portion of each length of wire to be formed into a retroflexed configuration in the cavity at the opposite end of the housing by applying forces to the wires in a controlled manner, the application of forces in a controlled manner being effective to allow the one end portions of the resilient lengths of wire to move pivotally into positions inclined to the center portions of the lengths of wire when the application of forces is discontinued;

said step of applying forces includes the forming of the one end portion of each length of wire by engaging it with a slotted tool to cause it to extend through a slot in the tool and by moving the tool in a path transversely of the wire lengths and then in a path generally parallel to the passageway to cause the one end portion of each wire length to be formed into a generally U-shaped configuration and in a controlled manner such that when the application of forces is discontinued, the one end portion of each length of resilient wires moves pivotally to be disposed at a predetermined angle to its center portion; and discontinuing the application of forces to the one end portion of each length of wire in the cavity at the opposite end of the housing.

11. The method of claim 10, where said step of applying forces in a controlled manner also includes applying lateral support to a portion of each of the elements positioned in the passageways on the end of the passageway adjacent to the cavity at the opposite end of the housing to hold the portions of the elements against the adjacent sides of the associated passageways during the pivoting of the one end portion of the elements.

12. A method of forming a plurality of wire-like metallic contact elements within a plastic housing with a center portion of each of the elements extending through a passageway having opposite surfaces and with end portions of each of the elements being disposed in cavities at opposite ends of the housing, said method including the steps of;

preforming each of a plurality of lengths of resilient wires to have an offset portion along a center portion thereof, the offset portion of each of the lengths of wire being spaced from an axis between its ends to cause the offset portion of the length of wire and portions adjacent to the center portion of the length of wire to engage opposite surfaces of the associated passageway in which it is to be disposed;

moving each of the plurality of lengths of wire into one end of the housing and causing the lengths of wire to be disposed in the housing with the offset portions thereof being disposed in the passageways;

holding each of the lengths of wire in the housing to prevent inadvertent lateral and longitudinal movement thereof;

causing one end portion of each length of wire to be formed into a retroflexed configuration in the cavity at the opposite end of the housing by applying forces to the wires in a controlled manner, the application of forces in a controlled manner being effective to allow the one end portions of the resilient lengths of wire to move pivotally into positions inclined to the center portions of the lengths of wire when the application of forces is discontinued;

said step of moving each of a plurality of lengths of wire into the housing includes the steps of supporting the housing with one end thereof disposed in a recess of a nest and inserting a length of each of the wires having an offset portion formed centrally thereof and a retroflexed portion at the opposite end thereof, into each passageway to cause the one end portion of each wire to extend into the recess, to cause the offset portion of each wire to be disposed in the associated passageway, and to cause the retroflexed portions of the wires to be disposed in the cavity at the one end of the housing, said method also including the steps of removing the housing from the nest, and inserting an anvil into the cavity at the one end of the housing to support the radiused portions of the retroflexed portions of the lengths of wire to prevent their inadvertent movement; and discontinuing the application of forces to the one end portion of each length of wire in the cavity at the opposite end of the housing.

13. An apparatus for forming a plurality of wire-like contact elements in a plastic housing with a center portion of each of the elements being disposed in a passageway which communicates with a plug-receiving cavity at one end of the housing and a plug-receiving cavity at the opposite end of the housing, said apparatus including:

a base means mounted on said base for forming a center portion of each of a plurality of lengths of resilient metallic wire at least one intermediate portion which is offset sufficiently from adjacent portions of each of the associated lengths of wire to permit the offset and adjacent portions of each of the lengths of wire to engage opposite surfaces of an associated passageway in which the length of wire is subsequently inserted;

means movably mounted on said base means for advancing each of the plurality of lengths of wire into one end of the housing and through the passageways to cause the lengths of wire to extend from the one end of the housing to the opposite end of the housing and cause the offset of each length of wire to be positioned in the associated passageway and in engagement with one side of the passageway while the adjacent portions of each length of wire are in engagement with the opposite side of the passageway;

first forming means movably mounted on said base means for causing a first end portion of each length of wire to be formed into a retroflexed configuration in the cavity at the opposite end of the housing by engaging and applying forces to the wires in a controlled manner while the lengths of wire are being held against longitudinal movement by the advancing means and;

second forming means movably mounted on said base means for causing a second end portion of each length of wire to be bent into a retroflexed configuration in the cavity at the one end of the housing by engaging and applying bending forces to second end portions of the lengths of wire in a controlled manner, while retraining longitudinal movement of the lengths of wire by the first forming means, to cause the second ends to bend beyond neutral positions assumed by the second end portions of the lengths of wire when the bending forces are removed therefrom, the application of forces in a controlled manner being effective to allow the end portions of the lengths of resilient wire to move pivotally into predetermined neutral positions when the application of bending forces applied to the second end portions is discontinued.

14. The apparatus of claim 13, wherein said first and second forming means cause each end portion of the lengths of wire to have a generally U-shaped configuration and said apparatus includes means mounted in said base means for applying lateral support to portions of each of the lengths of wire between its offset portion and its first end portion which are contained within the associated passageway during the forming of the first end portions of the lengths of wire into the generally U-shaped configuration to control deflection of those portions of the lengths of wire while the first end portions of the lengths of wire are moved pivotally into retroflexed configurations inclined to the center portions of the lengths of wire.

15. The apparatus of claim 13, which also includes means slidably mounted on said base means engaging portions of the lengths of each wire in the cavity at the opposite end of the housing to prevent inadvertent movement of the lengths of wire during the forming of each of the second end portions into a retroflexed configuration.

16. An apparatus for assembling a plurality of contact elements within successive plastic housings to cause the contact elements to extend from a cavity at one end of each of the housings through passageways to a cavity at the other end of each of the housings, said apparatus comprising:

a base means; a nest located on said base means for holding the successive housings;

means movably mounted on said base means for guiding and for advancing a plurality of lengths of wire from supplies thereof in substantially parallel paths into the cavity at the one end of each of the successive housings positioned in the nest;

means mounted on said base means for causing a portion of said guiding means to be disposed in the cavity at the one end of each of the successive housings to align said guiding means with the passageways of the successive housings;

means mounted on said base means for forming offsets at spaced intervals in each of the wires as successive sections of the wires are fed from the wire supplies to the housings, each offset in each wire length being spaced from a longitudinal axis of the wire to cause the offset and adjacent portions to engage opposite surfaces of the associated passageway when the offsets in the wires are fed into the passageways;

said means for guiding and advancing the plurality of lengths of wire in parallel paths causing each length of wire to be disposed in the housing with a leading end of each wire extending beyond the cavity at the opposite end of the housing and with the offset of each wire being disposed in the passageway and supporting the lengths of wire against longitudinal movement during a subsequent bending operation;

first forming means movably mounted on said base means for bending the leading end portion of each wire to cause the leading end portion of each wire to have a retroflexed configuration within the cavity at the opposite end of the housing and for supporting each leading end portion against unintended longitudinal movement and against deflection between its offset and retroflexed end portion while the lengths of the wire being formed are held against longitudinal movement by the guiding and advancing means;

cutting means mounted on said base means cooperating with said guiding and advancing means for severing the portions of the wires within the housing from the supplies to form trailing end portions subsequent to the bending of the leading end portions;

means movably mounted on said base means responsive to the severing of the wires for spacing said nest from said cutting means; and second forming means movably mounted on said base means responsive to the severing of the wires for bending the trailing end portion of each of the lengths of wire into a retroflexed configuration in the cavity at the one end of the housing while the lengths of wires are held against longitudinal movement by the first forming means, said first and second forming means cooperating with each and being effective to overbend each end portion of the lengths of resilient wire such that when said first and second means are disengaged from the lengths of wires, the end portions are moved pivotally to predetermined neutral positions where the end portion of the length of wires are adapted to engage terminals of plugs that are inserted into the cavities.

17. The apparatus of claim 16, wherein said first forming means includes tool means and means mounted on said base means for mounting said tool means for movement into and out of engagement with the leading end portions of wires in the cavity at the opposite end of the housing, said mounting means including means mounted on said base means for causing said tool means to be moved in a path of travel generally parallel with the passageways into engagement with one side of the leading portion of the lengths of wire and then transversely of the leading portions of the lengths of wires to bend the leading portions into the retroflexed configurations.

18. The apparatus of claim 16, wherein said cutting means includes a moveable bar mounted on said base means which spans the wires extending from said guide means and which includes a cutting blade attached to a side thereof, said bar being spring-biased to cause said blade to be disposed normally below the wires, said apparatus also including means mounted on said base means for moving said bar upwardly to cause said blade to sever the wires.

19. The apparatus of claim 16, wherein said second forming means includes an articulated tool head having a plurality of slots and said apparatus includes means mounted on said base means for mounting said second forming means for movement along a path of travel which is inclined to the paths of travel of the wires to engage the trailing ends of the wire lengths and bend them into a retroflexed configuration, and to stop the movement of the second forming means along the inclined path;

means operatively associated with said second forming means and responsive to the completion of the second forming means movement in the inclined path for causing said articulated tool head to be moved laterally of the retroflexed trailing end portions of the wire lengths to engage the trailing end portions of the wire lengths so that the portions thereof adjacent to the adjacent ends of the passageways are bent into U-shaped configuration.

20. The apparatus of claim 19, wherein said articulated tool head is mounted pivotally about a first slide and is pin-connected to an end of a second slide, said second slide being mounted on said base means and said second forming means also including a rocker arm which is mounted pivotally to cause an end thereof to engage an opposite end of the second slide, a stop operatively associated with said second slide, and means mounted on said base means for moving the first and second slides, the movement of said rocker arm into engagement with said stop causing said rocker arm to be moved pivotally to cause said second slide to be moved relative to said first slide, the movement of said second slide relative to said first slide causing said articulated tool head be moved pivotally to bend the trailing end portions of the lengths of wire into a retroflexed configuration.

21. The apparatus of claim 16, wherein said nest is mounted on a carriage, said carriage being mounted on said base means and subsequent to the loading of a housing into said nest, said carriage is caused to be moved to position the cavity at the one end of the housing adjacent to said guide means, said nest also including:

clamping means mounted on said base means for securing the housing within said nest, said clamping means including means for positioning the housing within the nest to align the passageways of the housing with said guide means.

22. The apparatus of claim 16, wherein said means for forming an offset at spaced intervals along each of the wire lengths includes a punch and a die and wherein said punch is movably mounted with respect to said die and the engagement of said punch with said die to form offsets clamps the offsets in engagement with said die while said moving means causes said punch and die means to be advanced toward the housing to position previously formed offsets in the passageways of the housing in said nest, said apparatus also including:

means mounted on said base means and interposed between said severing means and said punch and die for clamping the wires, and wherein subsequent to the severing of the wires, said clamping means is caused to secure the wires while said punch is disengaged from said die and said punch and die are moved to an initial position for another cycle of forming offsets in the wire supplies.

23. An apparatus for forming a plurality of wire-like metallic contact elements within a plastic housing with a center portion of each extending through a passageway and with end portions of each being retroflexed and disposed in cavities at opposite ends of the housing, said apparatus including:

a base means; movably mounted on said base means for moving each of a plurality of resilient metallic wires into the cavity at one end of the housing with offset center portions of the wires being disposed in the passageways and cooperating with adjacent portions of the wires to engage opposite surfaces of each of the passageways, and with one end portion of each of the wires being disposed in the cavity at the opposite end of the housing;

means mounted on said base means for holding the wires in the housing to prevent inadvertent longitudinal movement of the wires;

tool means mounted on said base means for applying forces to one end portion of each wire in the cavity at the opposite end of the housing while the wires are held against longitudinal movement by the means for preventing longitudinal movement of the wires by the tool means to cause the one end portions of the wires to assume retroflexed configurations; and means mounted on said base means for applying lateral support on portions of each wire between its offset portion and its one end portion contained within the adjacent ends of the passageways in a controlled manner such that when said tool means is disengaged from the wires the one end portion of each of the wires is moved pivotally to a predetermined neutral retroflexed configuration.

24. The apparatus of claim 23, wherein said tool means includes a slotted tool adapted to have a wire received in each slot and said tool is adapted to be moved transversely of the wires and then in a path generally parallel to the passageways to cause the one end portion of each wire to be formed in a generally U-shaped configuration and in a manner such that when the tool is withdrawn from the one cavity, the one end portion of each reslient wire moves pivotally to a predetermined retroflexed configuration.

25. The apparatus of claim 24, wherein said tool means includes a forming portion which is adapted to be received in the cavity at the opposite end of the housing and which includes a plurality of slots each adapted to receive an end portion of a wire when said tool is moved transversely of the wires; said forming portion including an undercut portion which is adapted to be engaged with the opposite end of the housing as the wires are received in said slots to allow said tool to be moved pivotally about the opposite end of the housing and into the cavity.

* * * * *